US012129656B2

(12) United States Patent
Schneider

(10) Patent No.: US 12,129,656 B2
(45) Date of Patent: Oct. 29, 2024

(54) STEP CLIP FASTENING SYSTEM AND METHOD

(71) Applicant: Barrette Outdoor Living, Inc., Middleburg Heights, NJ (US)

(72) Inventor: Christopher Michael Schneider, Linwood, NJ (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 0 days.

(21) Appl. No.: 18/225,311

(22) Filed: Jul. 24, 2023

(65) Prior Publication Data

US 2023/0399854 A1 Dec. 14, 2023

Related U.S. Application Data

(60) Division of application No. 17/373,868, filed on Jul. 13, 2021, now Pat. No. 11,746,533, which is a (Continued)

(51) Int. Cl.

| | |
|---|---|
| ***E04F 13/08*** | (2006.01) |
| ***E04F 13/24*** | (2006.01) |
| ***E04F 15/02*** | (2006.01) |

(52) U.S. Cl.

CPC ..... *E04F 13/0803* (2013.01); *E04F 13/0862* (2013.01); *E04F 13/24* (2013.01); *E04F 15/02044* (2013.01)

(58) Field of Classification Search

CPC ... E04F 13/0803; E04F 13/0862; E04F 13/24; E04F 15/02044; E04F 2201/0153; (Continued)

(56) References Cited

U.S. PATENT DOCUMENTS 2,003,996 A 6/1935 Finzer et al.
2,103,569 A * 12/1937 Wallace ..... E04F 13/0803 52/774

(Continued)

FOREIGN PATENT DOCUMENTS

AU 2020203897 A1 1/2021
AU 2020203907 A1 1/2021

(Continued)

OTHER PUBLICATIONS

"Duralife Decking Installation Using the Step-Clip Fastening System" video posted by DuraLife by Barrette Outdoor Living on Dec. 8, 2017, Retrieved from: https://www.youtube.com/watch?v=hhxfNsoJCWw Transcript retrieved on: Aug. 1, 2022 (9 pages total).

(Continued)

*Primary Examiner* — Andrew J Triggs
(74) *Attorney, Agent, or Firm* — John Maldjian, Esq.; Stevens & Lee PC

(57) ABSTRACT

A method of assembling a deck board by using a step clip fastening device is disclosed. The method comprising the steps of fastening the step clip fastening device onto a joist by using a plurality of fastening tools; sliding a first end of the deck board into an inner cavity of a step clip attached at a first end of the step clip fastening device; and snapping a second end of the deck board into an inner cavity of a corresponding step clip facing the step clip attached at the first end of the step clip fastening device to form a mating relationship between the deck board and the step clip fastening device.

20 Claims, 16 Drawing Sheets

Related U.S. Application Data continuation of application No. 17/071,567, filed on Oct. 15, 2020, now Pat. No. 11,105,100, which is a division of application No. 16/887,098, filed on May 29, 2020, now Pat. No. 10,889,994.

(60) Provisional application No. 62/865,519, filed on Jun. 24, 2019.

(58) Field of Classification Search
CPC ..... E04F 2021/0161; E04F 2021/0169; E04F 2021/0176; E04F 2021/0184; E04F 2021/0192
See application file for complete search history.

(56) References Cited

U.S. PATENT DOCUMENTS

| | | | | |
|---|---|---|---|---|
| 2,832,102 | A | 4/1958 | Amoruso | |
| D195,504 | S | 6/1963 | Walte | |
| 3,197,934 | A | 8/1965 | Brown | |
| 3,253,377 | A | 5/1966 | Schakel | |
| D205,891 | S | 10/1966 | Feliziani | |
| 3,321,883 | A | 5/1967 | Pascucci | |
| 3,472,118 | A | 10/1969 | Jureit | |
| D222,895 | S | 1/1972 | Zampetti et al. | |
| 3,807,675 | A | 4/1974 | Seckerson et al. | |
| D250,847 | S | 1/1979 | Lemieux | |
| 4,209,043 | A | 6/1980 | Menzel | |
| 4,226,064 | A | 10/1980 | Kraayenhof | |
| 4,700,527 | A | 10/1987 | Pardo | |
| 4,807,412 | A | 2/1989 | Frederiksen | |
| 5,067,677 | A | 11/1991 | Miceli | |
| D326,999 | S | 6/1992 | Johnson et al. | |
| 5,323,575 | A | 6/1994 | Yeh | |
| 5,390,457 | A | 2/1995 | Sjoelander | |
| 5,390,462 | A | 2/1995 | Kreiter | |
| D365,007 | S | 12/1995 | Sheftel | |
| D379,427 | S | 5/1997 | Laga | |
| 5,628,160 | A | 5/1997 | Kueng | |
| 5,827,441 | A | 10/1998 | Solbjoerg | |
| D404,504 | S | 1/1999 | Dickey | |
| D415,408 | S | 10/1999 | Wizikowski, Sr. | |
| D415,913 | S | 11/1999 | Ernst | |
| D427,048 | S | 6/2000 | Potter et al. | |
| D438,650 | S | 3/2001 | Neuhofer, Jr. | |
| D462,665 | S | 9/2002 | Witting | |
| 6,694,691 | B2 | 2/2004 | Ku | |
| D518,616 | S | 4/2006 | Goodwin | |
| 7,114,298 | B2 | 10/2006 | Kotler | |
| D552,269 | S | 10/2007 | Vibiano et al. | |
| D561,102 | S | 2/2008 | Taneno et al. | |
| D568,254 | S | 5/2008 | Patchett et al. | |
| 7,543,417 | B2 | 6/2009 | Mcintosh et al. | |
| D597,493 | S | 8/2009 | Wu | |
| D600,366 | S | 9/2009 | Boardman | |
| D609,373 | S | 2/2010 | Curtas | |
| D621,076 | S | 8/2010 | Vibiano | |
| 7,793,470 | B1 | 9/2010 | Mathiesen et al. | |
| 7,975,728 | B2 | 7/2011 | Melville et al. | |
| D656,006 | S | 3/2012 | Underkofler et al. | |
| 8,146,303 | B2 * | 4/2012 | Gibson | E04B 5/12 52/489.1 |
| 8,186,116 | B2 | 5/2012 | Anderson | |
| 8,205,407 | B2 | 6/2012 | Genova | |
| D663,045 | S | 7/2012 | Ryan | |
| 8,230,654 | B2 | 7/2012 | Mcintosh et al. | |
| 8,266,857 | B2 | 9/2012 | David | |
| D681,438 | S | 5/2013 | Chen | |
| 8,539,727 | B2 | 9/2013 | Lui | |
| 8,561,356 | B2 | 10/2013 | Chuang | |
| 8,973,326 | B2 | 3/2015 | Lenoci | |
| D728,349 | S | 5/2015 | Lake | |
| 9,038,341 | B2 | 5/2015 | Lam et al. | |
| D733,933 | S | 7/2015 | Lee et al. | |
| 9,181,716 | B1 * | 11/2015 | Gibson | E04B 1/38 |
| D750,282 | S | 2/2016 | Lippeatt | |
| 9,309,677 | B1 | 4/2016 | Anic | |
| D755,043 | S | 5/2016 | Bailey | |
| 9,416,546 | B2 * | 8/2016 | Claudin | E04B 5/02 |
| 9,458,635 | B1 * | 10/2016 | Anic | E04F 15/02166 |
| 9,499,979 | B2 | 11/2016 | Huang et al. | |
| 9,528,277 | B2 | 12/2016 | Prati et al. | |
| 9,593,490 | B2 | 3/2017 | Anic | |
| D788,947 | S | 6/2017 | Gilkey et al. | |
| 9,869,096 | B2 | 1/2018 | Brochu et al. | |
| D824,755 | S | 8/2018 | Bauer et al. | |
| 10,472,111 | B2 | 11/2019 | Li | |
| 10,472,817 | B2 | 11/2019 | Harnish et al. | |
| 10,487,460 | B2 * | 11/2019 | Lee | E04F 15/02183 |
| D893,289 | S | 8/2020 | Oetlinger et al. | |
| D893,875 | S | 8/2020 | Hsieh | |
| 10,781,595 | B2 | 9/2020 | Mcintosh et al. | |
| D902,023 | S | 11/2020 | Briese | |
| D902,684 | S | 11/2020 | Barraco | |
| 10,842,303 | B1 | 11/2020 | Vieveen | |
| D905,286 | S | 12/2020 | Hay, III | |
| 10,889,994 | B1 * | 1/2021 | Schneider | E04F 13/0862 |
| 10,941,577 | B1 | 3/2021 | Bennett et al. | |
| D922,186 | S * | 6/2021 | Schneider | D25/123 |
| 11,105,100 | B2 * | 8/2021 | Schneider | E04F 13/24 |
| 11,156,005 | B2 | 10/2021 | Schneider et al. | |
| 11,454,032 | B2 * | 9/2022 | Schneider | E04F 15/02044 |
| 11,746,533 | B2 * | 9/2023 | Schneider | E04F 13/0803 52/712 |
| 2003/0136070 | A1 | 7/2003 | Ku | |
| 2003/0177728 | A1 | 9/2003 | Ku | |
| 2005/0034395 | A1 | 2/2005 | Kotler | |
| 2005/0034403 | A1 | 2/2005 | Chen | |
| 2006/0185297 | A1 | 8/2006 | Mei | |
| 2007/0094969 | A1 | 5/2007 | Mcintosh et al. | |
| 2008/0313987 | A1 | 12/2008 | Ibanez et al. | |
| 2009/0266022 | A1 | 10/2009 | Lin | |
| 2010/0146900 | A1 * | 6/2010 | Holland | E04F 15/02 52/715 |
| 2010/0257801 | A1 | 10/2010 | Anderson | |
| 2010/0263317 | A1 | 10/2010 | Genova | |
| 2010/0313509 | A1 | 12/2010 | Mcintosh et al. | |
| 2011/0120037 | A1 | 5/2011 | Barlow et al. | |
| 2011/0289875 | A1 | 12/2011 | Lenoci | |
| 2012/0117910 | A1 | 5/2012 | Chuang | |
| 2015/0059271 | A1 | 3/2015 | Tsai | |
| 2015/0096250 | A1 | 4/2015 | Lam et al. | |
| 2015/0292217 | A1 | 10/2015 | Prati et al. | |
| 2017/0226752 | A1 | 8/2017 | Tsai | |
| 2017/0298638 | A1 | 10/2017 | Bosman | |
| 2018/0194502 | A1 | 7/2018 | Li | |
| 2019/0010710 | A1 | 1/2019 | Choy | |
| 2020/0232227 | A1 | 7/2020 | Mcintosh et al. | |
| 2020/0340256 | A1 | 10/2020 | Lee et al. | |
| 2020/0407982 | A1 | 12/2020 | Schneider et al. | |
| 2021/0164235 | A1 | 6/2021 | Schneider | |
| 2022/0136254 | A1 | 5/2022 | Schneider | |
| 2023/0183983 | A1 * | 6/2023 | Schneider | E04F 13/0862 52/747.1 |
| 2023/0399854 | A1 * | 12/2023 | Schneider | E04F 13/0862 |

FOREIGN PATENT DOCUMENTS

| | | | |
|---|---|---|---|
| CA | 191110 | A | 6/1919 |
| CA | 3072633 | A1 | 12/2020 |
| CA | 3084539 | A1 | 12/2020 |
| CA | 3084539 | C | 12/2022 |
| FR | 2989713 | A1 | 10/2013 |
| KR | 101907111 | B | 10/2018 |
| NZ | 765647 | | 6/2020 |
| NZ | 765671 | | 6/2020 |
| WO | 2010079462 | A1 | 7/2010 |

OTHER PUBLICATIONS

"Duralife Step-Clip Demonstration" from the 2018 Erie Materials Contractor Expo, video posted by DuraLife by Barrette Outdoor

(56) References Cited

OTHER PUBLICATIONS

Living on Mar. 30, 2018, Retrieved from: https://www.youtube.com/watch?v=VNvNj-J4iql Transcript retrieved on: Aug. 1, 2022 (5 pages total).
"DuraLife Step-Clip Time Study" video posted by DuraLife by Barrette Outdoor Living on Oct. 12, 2017, Retrieved from: https://www.youtube.com/watch?v=2loA0CFN3wl Transcript retrieved on: Aug. 1, 2022 (2 pages total).
"Step Clip for Kebony with Brian Gurry, USA" video posted by Kebony Wood on Jun. 4, 2019, Retrieved from: https://www.youtube.com/watch?v=WKGqnIPM2ec Transcript retrieved on: Aug. 1, 2022 (7 pages total).
Canadian Requisition dated May 8, 2023 in connection with corresponding Canadian Application No. 3,072,633 (5 pages total).
Canadian Requisition issued May 8, 2023 in connection with corresponding Canadian Application No. 3,072,633 (5 pages total).
DuraLife by Barrette Outdoor Living, "It's a SNAP with Step-Clip", Facebook, Oct. 12, 2017, 3 minutes, Retrieved from: https://www.facebook.com/DuraLifeDecking/videos/1472933289463502/ Images from post retrieved on Aug. 1, 2022 '5 pages total).
First Australian Examination Report dated Feb. 3, 2021 issued in connection with corresponding Australian Patent Application No. 2020203897 (5 pages total).
First Australian Examination Report dated Mar. 17, 2021 issued in connection with corresponding Australian Patent Application No. 2020203907 (10 pages total).
Machine translation of foreign reference FR2989713, obtained from https://translationportal.epo.org/emtp/translate/?ACTION=description-retrieval&COUNTRY=FR&ENGINE=google&FORMAT=docdb&KIND=A1&LOCALE=en_EP&NUMBER=2989713&SRCLANG=fr&TRGLANG=en (last accessed on Feb. 19, 2021) (Year: 2021).
Second Australian Examination Report dated Jun. 22, 2021 in connection with corresponding Australian Patent Application No. 2020203907 (4 pages total).
Second Australian Examination Report issued in connection Jun. 22, 2021 in connection with corresponding Australian Patent Application No. 2020203907 (4 pages total).

* cited by examiner

STEP CLIP FASTENING SYSTEM AND METHOD

CROSS-REFERENCE TO RELATED APPLICATIONS

This application is a divisional of U.S. application Ser. No. 17/373,868 filed Jul. 13, 2021, entitled, "STEP CLIP FASTENING SYSTEM AND METHOD", which is a continuation of U.S. application Ser. No. 17/071,567 filed Oct. 15, 2020, entitled, "Step Clip Fastening System and Method" now U.S. Pat. No. 11,105,100, which is a divisional of U.S. application Ser. No. 16/887,098 filed May 29, 2020, entitled, "Step Clip Fastening System and Method", now U.S. Pat. No. 10,889,994 and claims the benefit of U.S. Provisional Application Ser. No. 62/865,519 filed Jun. 24, 2019, entitled "Step Clip Fastening System and Method", which are incorporated herein by reference in their entirety.

FIELD OF INVENTION

Embodiments of the present invention generally relate to a deck fastening system and method, and particularly to a system and method for fixing deck boards on a surface of a joist by using a step clip arrangement.

BACKGROUND

A deck is a flat surface elevated from a ground surface generally provided in apartments, restaurants, etc. for walking, relaxing, and so forth. Typically, a deck is constructed by using deck boards fastened to parallel joists by using fastening tools. While, joists may be supporting structures for a decking system that uses insertable fasteners to join pieces, sections, or supporting decks. Further, the decking systems make use of fastening tools such as, but not limited to, a screw, a nail or a staple to attach decking members to underlying joists.

In some cases, securing deck boards include driving a fastener through an upper surface of a deck board, thereby making the fastener visible. Even the fasteners can become increasingly unsightly overtime, as metal fasteners have a tendency to corrode. Also, the fasteners can get loose or become out of position on the joists by time.

Conventional deck fastening systems for installing modular deck boards use clips made of steel or similar materials. These clips hold the deck boards on the subsurface consisting of joists. However, the deck boards on the joists may slip from the clips, which may cause the deck boards to slide out of an engagement in a horizontal direction. Further, to eliminate the above problem, the deck boards has to be screwed down at each end of the deck to hold the deck boards in position by using the fastening tools. In addition, conventional decking systems also require a protection tape in order to protect the surface of the joist from water damage, rot, decay, and so forth.

There is thus a need for a step clip fastening system and method that may restrict the horizontal sliding of deck boards and further reduce time and manpower required for an installation of deck boards in a more efficient manner.

SUMMARY

Embodiments in accordance with the present invention provide a step clip fastening device. The step clip fastening device comprise an elongated base strip having a first end and a second end, wherein a female locking part attached to the first end and a male locking part attached to the second end. The step clip fastening device further comprises a plurality of step clip sets extending substantially perpendicularly upwards from the base strip, wherein each of the step clip set comprising at least two step clips arranged in a back-to-back configuration, wherein a step clip is attached at each of the first end and the second end of the base strip. The step clip fastening device further comprises an anchor protruded at a center of each of the step clip. The step clip fastening device further comprises one or more tabs extending substantially perpendicularly downwards from the base strip between two corresponding step clips facing each other.

Embodiments in accordance with the present invention provide a deck fastening system for securing a plurality of deck boards over a surface of a joist. The deck fastening system comprises the plurality of deck boards, wherein each of the deck board comprising an upper surface and a lower surface. The deck fastening system further comprises one or more step clip fastening devices, wherein each of the step clip fastening device comprising an elongated base strip having a first end and a second end, wherein a female locking part is attached to the first end and a male locking part attached to the second end. The deck fastening system further comprises a plurality of step clip sets extending substantially perpendicularly upwards from the base strip, wherein each of the step clip set comprising at least two step clips arranged in a back-to-back configuration, wherein a step clip is attached at each of the first end and the second end of the base strip. The deck fastening system further comprises an anchor protruded at a center of each of the step clip. The deck fastening system further comprises one or more tabs extending substantially perpendicularly downwards from the base strip between two corresponding step clips facing each other.

Embodiments in accordance with the present invention provide a method of assembling a deck board by using a step clip fastening device. The method comprising the steps of rigidly attaching a step clip fastening device on a surface of a joist, wherein each tab of the step clip fastening device is positioned along a side surface of the joist; fastening the step clip fastening device by using one more fastening tools on the joist; positioning the deck board across two corresponding step clips facing each other of the step clip fastening device; sliding a first end of the deck board into an inner cavity of a first end of the step clip fastening device such that the step clip fastening device is engaged within a groove of the deck board; and snapping a second end of the deck board into an inner cavity of a corresponding step clip of the step clip fastening device to form a mating relationship between the deck board and the step clip fastening device through an anchor protruded at the center of each step clip of the step clip fastening device, wherein the anchor digs into the deck board.

In an embodiment of the present invention, the step clip comprises the anchor protruded at a center of an inner cavity. The anchor may be a small arc shaped protrusion disposed at the inner cavity of the step clip. The anchor may be made up of a metal piece (such as stainless steel). In another embodiment of the present invention, the anchor may be replaced with a rubber like material or any other such material known to a person skilled in the art, over-molded on the inner side surface of the step clip.

According to another embodiment of the present invention, the anchor may be a washer, or a molded protrusion, disposed at the inner cavity of the step clip.

According to an embodiment of the present invention, the anchors may provide enough friction to the deck boards and thus, restricting the movement of the deck boards in the horizontal direction.

According to another embodiment of the present invention, the tab may be arc head shaped, which may be used to align the step clip fastening device on the surface of the joist, in an embodiment of the present invention. In another embodiment of the present invention, the tab may be an oval head shaped.

In an embodiment of the present invention, the step clip sets and the step clips are arranged along a length of the base trip at an equal distance. In another embodiment of the present invention, the step clip sets and the step clips are arranged along the length of the base trip at a variable distance. The plurality of step clip sets and the step clips are made of a material comprising a glass filled polypropylene, in an embodiment of the present invention.

According to another embodiment of the present invention, a width of the base strip of the step clip fastening device may be made such that it extends over an edge of the joist surface thus, protecting a top of the joist from water damage, rot and decay, and therefore eliminating the need for a joist protection tape.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of embodiments of the present invention will become apparent upon consideration of the following detailed description of embodiments thereof, especially when taken in conjunction with the accompanying drawings, and wherein.

Figure 1:
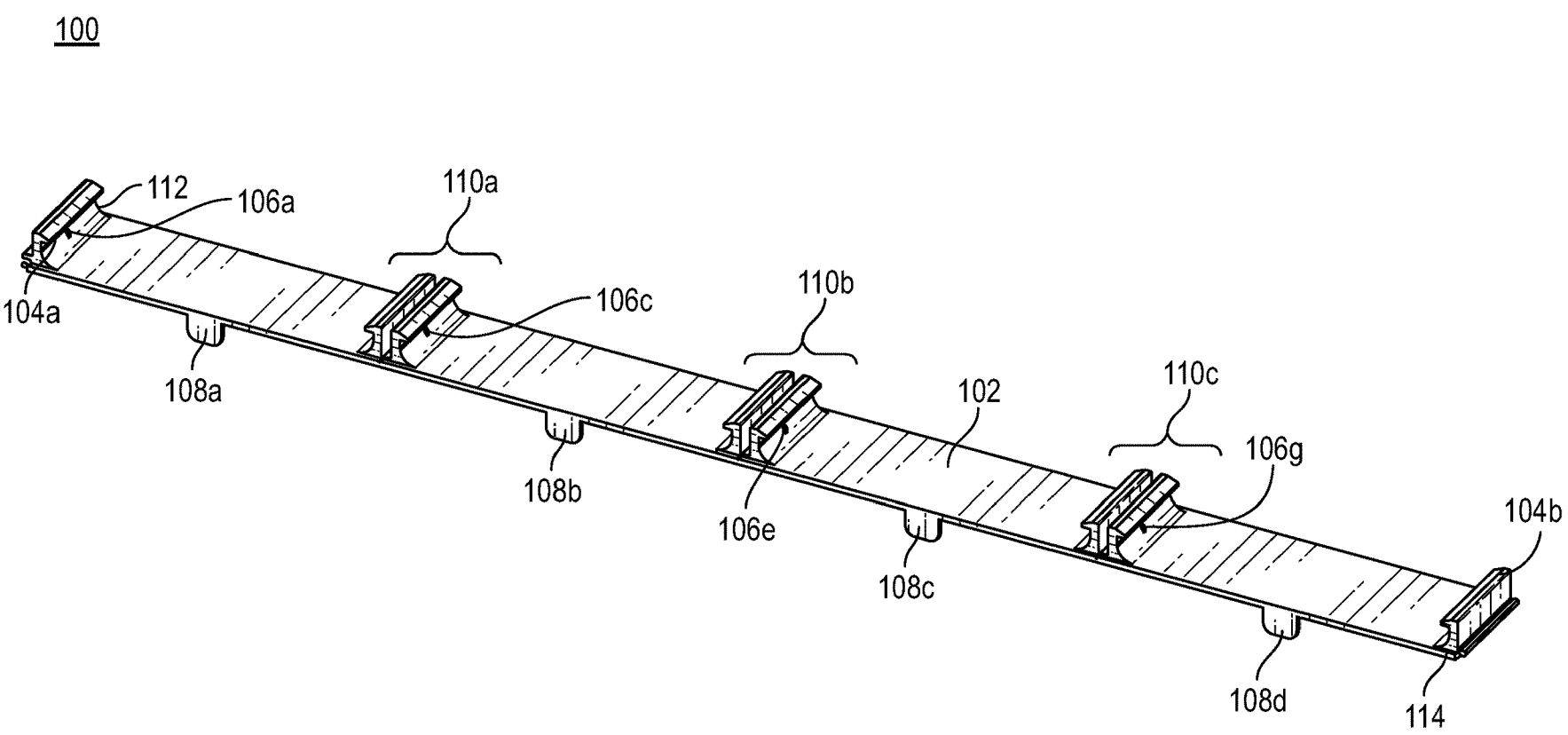
FIG. 1 illustrates a perspective view of a step clip fastening device, according to an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

FIG. 1 illustrates a perspective view of a step clip fastening device 100, according to an embodiment of the present invention. The step clip fastening device 100 comprises an elongated base strip 102, a plurality of step clips 104*a*-104*b* (interchangeably referred to as the step clip 104), a plurality of anchors 106*a*-106*g* (hereinafter referred to as the anchor 106), a plurality of tabs 108*a*-108*d* (hereinafter referred to as the tab 108), and a plurality of step clip sets 110*a*-110*c* (hereinafter referred to as the step clip set 110).

In an embodiment of present invention, the base strip 102 may be made up of a material such as, but not limited to, a plastic, a synthetic rubber, a natural rubber, and so forth. In a preferred embodiment of present invention, the base strip 102 may be made up of a glass filled polypropylene. Embodiments of the present invention are intended to include or otherwise cover any material of the base strip 102 including known, related art, and/or later developed technologies that may be beneficial to provide dimensional stability, rigidity and strength to the base strip 102. According to an embodiment of the present invention, a width of the base strip 102 may be made slightly greater than a width of the step clip 104 such that the slightly greater width of the base strip 102 enables the base strip 102 to extend over an edge of a surface of a joist, according to an embodiment of the present invention.

Further, the step clip 104 of the step clip fastening device 100 may extend substantially perpendicularly upwards from the base strip 102, in an embodiment of the present invention. Further, the step clip 104 may comprise an inner cavity at one side and a flat vertical surface at an opposite side, according to embodiments of the present invention. According to embodiments of the present invention, the step clip 104*a* may be attached to a first end 112 of the base strip 102 and the step clip 104*b* may be attached a second end 114 of the base strip 102.

According to an embodiment of the present invention, the step clip set 110 of the step clip fastening device 100 may extend substantially perpendicularly upwards from the base strip 102. Further, the step clip set 110 may be provided along a length of the base strip 102, according to an embodiment of the present invention. In an embodiment of the present invention, the step clip set 110 may be arranged along a length of the base strip 102 at an equal distance between the step clip 104*a* and the step clip 104*b*. In another embodiment of the present invention, the step clip set 110 may be arranged along the length of the base strip 102 at a variable distance between the step clip 104*a* and the step clip 104*b*. Further, each of the step clip set 110 may be made by arranging two step clips 104 in a back-to-back configuration, in an embodiment of the present invention. According to an embodiment of the present invention, the step clip fastening device 100 may comprise at least three step clip sets 110 arranged on the base strip 102 between the step clip 104*a* attached to the first end 112 of the base strip 102 and the step clip 104*b* attached to the second end 114 of the base strip 102. Further, the step clip 104*a* and the step clip 104*b* may be attached to the base strip 102 such that the inner cavity of the step clip 104*a* faces the inner cavity of the step clip 104*b*, according to an embodiment of the present invention. Further the step clip 104 may be made up of a glass filled polypropylene material, according to embodiments of the present invention. Embodiments of the present invention are intended to include or otherwise cover any of the material for the step clip 104 including known, related art, and/or later developed technologies.

Figure 9A:
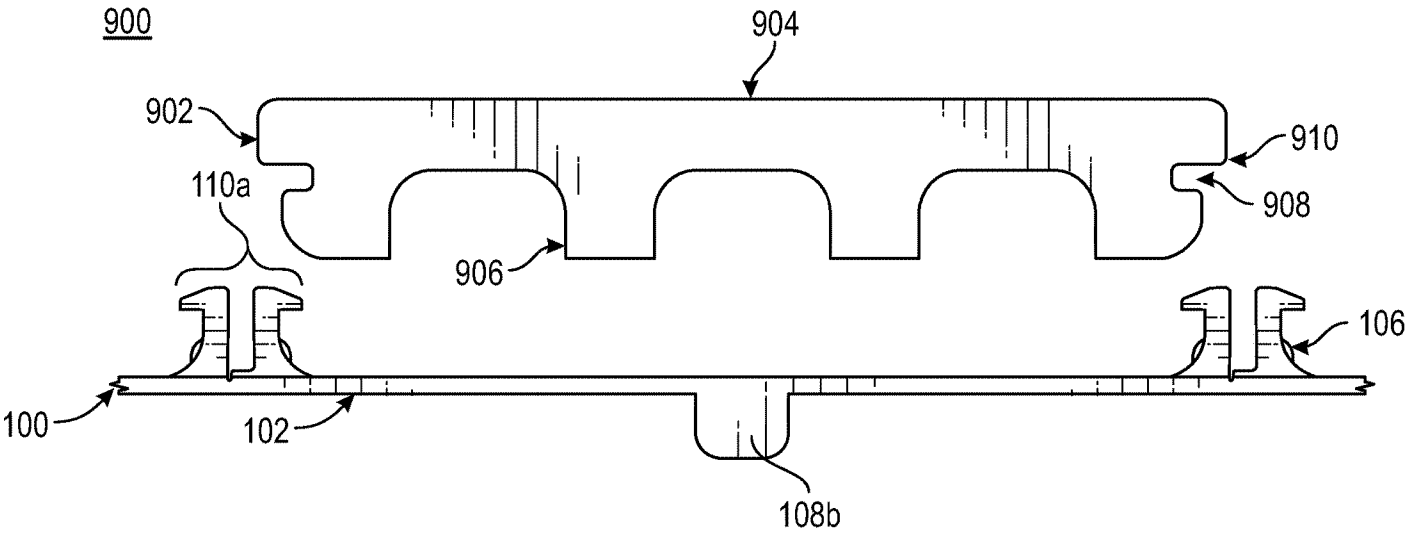
FIGS. 9A to 9C illustrate a deck board fastening system in which a deck board is snapped into the step clip fastening device, according to an exemplary embodiment of the present invention.
Figure 9B:
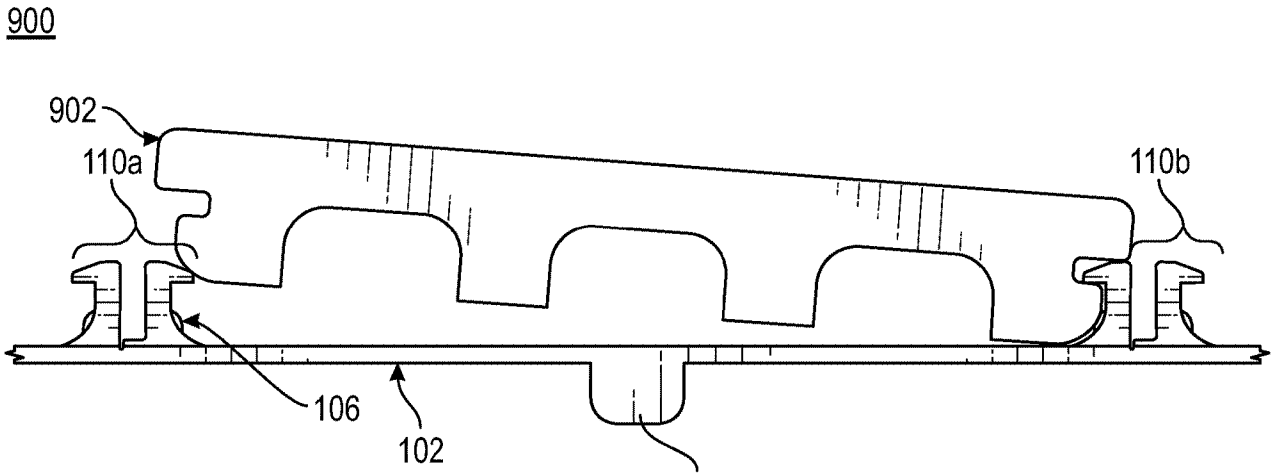
Figure 9C:
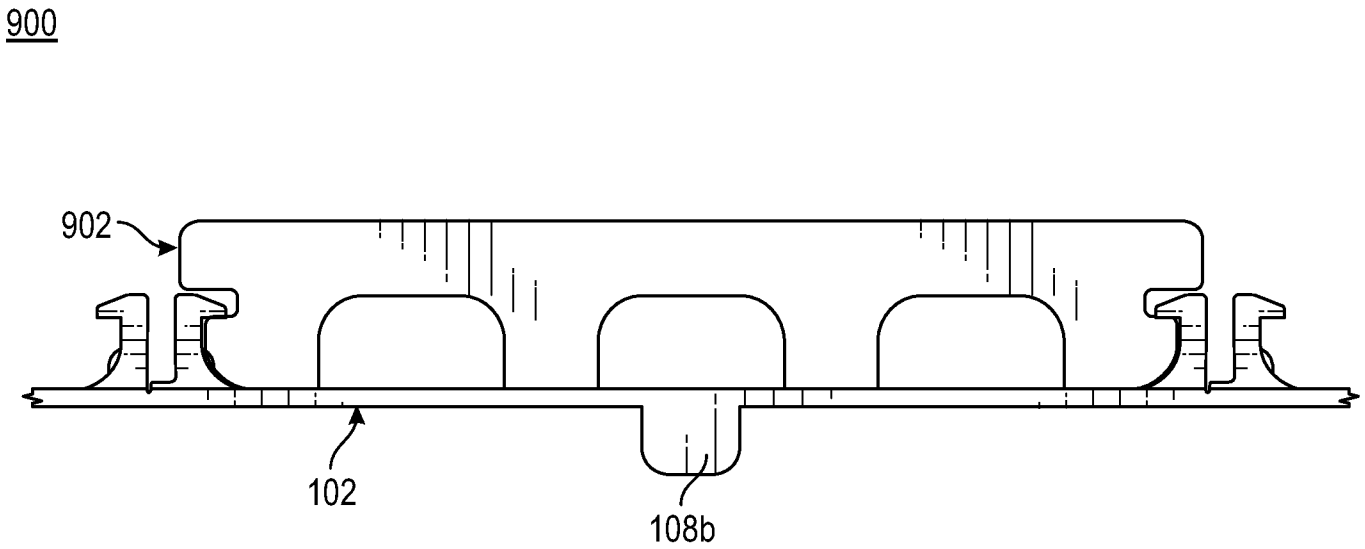

In an embodiment of the present invention, the step clip 104 further comprises the anchor 106 disposed on the inner cavity of the step clip 104, according to embodiments of the present invention. The anchor 106 may be a small arc shaped protrusion disposed at the inner cavity of the step clip 104, in an embodiment of the present invention. Further, the anchor 106 may be designed to provide enough friction to a deck board (as shown in FIGS. 9A-9C) installed onto the step clip fastening device 100 and restricting the movement of the deck board in a horizontal direction. In an embodiment of the present invention, the anchor 106 may be made up of a metal piece such as, but not limited to, stainless steel. In another embodiment of the present invention, the anchor 106 may be made up of a rubber material that may be over-molded at the inner cavity of the step clip 104. In yet another embodiment of the present invention, the anchor 106 may be a washer and/or a molded protrusion disposed at the inner cavity of the step clip 104. According to an embodiment of the present invention, the anchor 106 may be removably attached to the inner cavity of the step clip 104. In yet another embodiment of the present invention, the anchor 106 may be permanently attached to the inner cavity of each of the step clip 104. Embodiments of the present invention are intended to include or otherwise cover any type of the anchor 106 including known, related art, and/or later developed technologies that may be beneficial in providing friction to the deck board installed using the step clip fastening device 100 to restrict the movement of the deck board in the horizontal direction.

Furthermore, the step clip fastening device 100 comprises the tab 108 extending substantially perpendicularly downwards from the base strip 102 between two adjacent step clips 104 facing each other, according to embodiments of the present invention. The tab 108 may be an arc head shaped tab that may be used to align the step clip fastening device 100 on a surface of the joist, in an embodiment of the present invention. In another embodiment of the present invention, the tab 108 may be an oval head shaped tab. Further, the tab 108 may be designed to align with a side wall of the joist to keep the step clip fastening device 100 parallel to the surface of the joist for assisting in quick and efficient installation, according to embodiments of the present invention. In an embodiment of the present invention, the tab 108 may be aligned at one side of the base 102 of the step clip fastening device 100.

Figure 2:
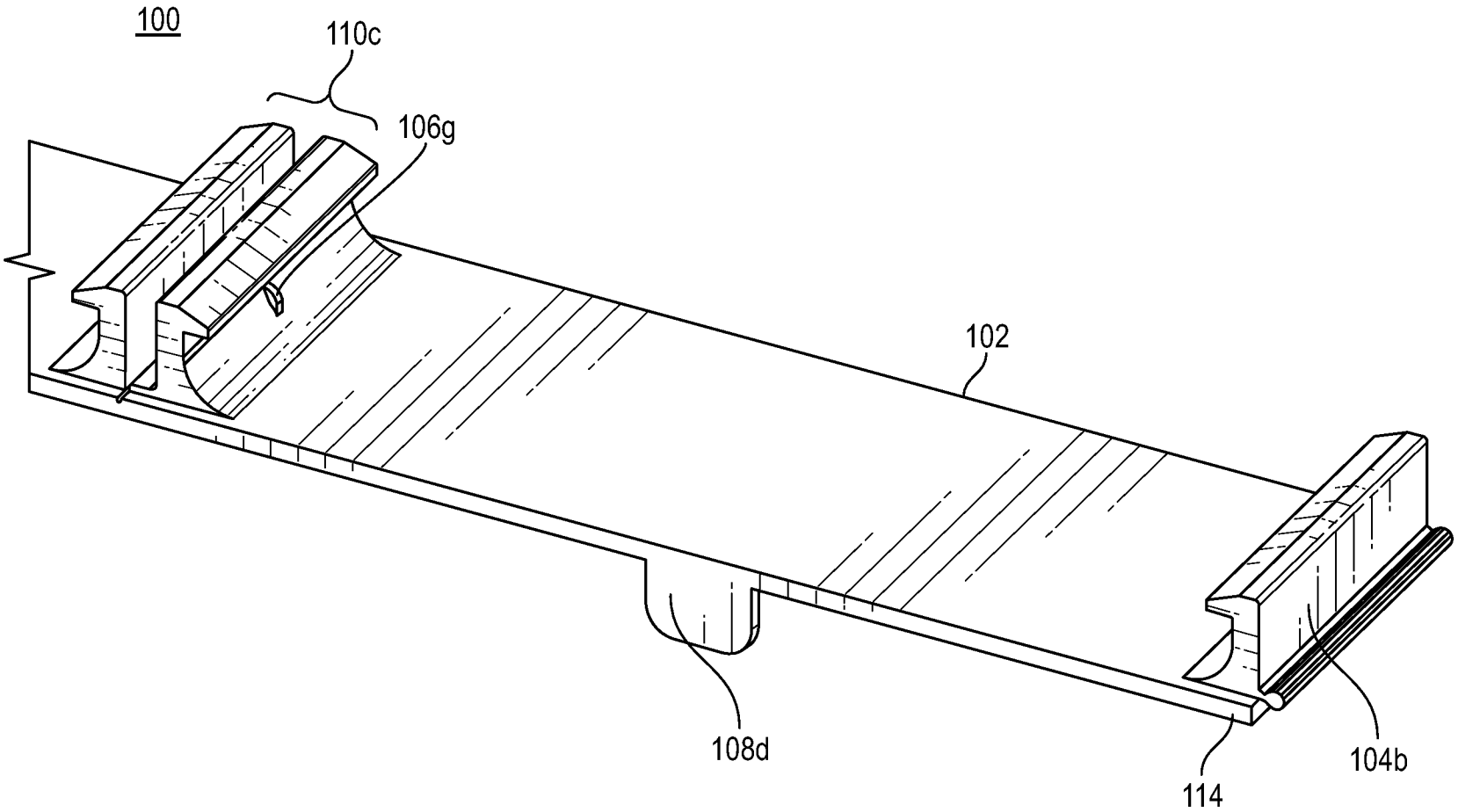
FIG. 2 illustrates an enlarged partial view of the step clip fastening device, according to an embodiment of the present invention.

FIG. 2 illustrates an enlarged partial view of the step clip fastening device 100, according to an embodiment of the present invention. The step clip fastening device 100 comprises the elongated base strip 102, the step clip 104*b* attached to the second end 114 of the base strip 102, the anchor 106*g*, and the tab 108*d*. The base strip 102 is preferably made up of a material comprising a glass filled polypropylene, in an embodiment of the present invention. In an embodiment of the present invention, the width of the base strip 102 is made slightly greater than the width of the step clip set 110*c*, such that the base strip 102 extends over the edges of the surface of the joist. The step clip 104*b* is attached at the second end 114 of the base strip 102, according to an embodiment of the present invention. In an embodiment of the present invention, the step clip 104*b* and step clip set 110*c* may be provided along a length of the base strip 102. Further, the step clip set 110*c* may be designed to extend substantially perpendicularly upwards from the base strip 102, in an embodiment of the present invention. According to embodiments of the present invention, the step clip set 110*c* comprises at least two step clip 104 arranged in a back-to-back configuration. As discussed above, the step clip 104 of the step clip set 110*c* comprises the anchor 106*g* that may be protruded at the center of the inner cavity of the step clip 104. In an embodiment of the present invention, the anchor 106*g* may be made up of a metal piece such as, but not limited to, stainless steel. The anchor 106*g* may be a small arc shaped protrusion, in an embodiment of the present invention. In another embodiment of the present invention, the anchor 106*g* may be a washer, or a molded protrusion disposed at the inner cavity of the step clips 104 of each of the step clip set 110. The anchor 106*g* may be provided to dig into a bottom surface of a deck board (as shown in the FIG. 9A-9C), when the deck board is snapped into the step clip fastening device 100. Further, the anchor 106*g* may deform the bottom of the deck board and may restrict a movement of the deck board while it is snapped into the step clip fastening device 100 in a horizontal direction.

Further, the tab 108*d* may be provided that extends substantially perpendicularly downwards from the base strip 102 between two corresponding step clip 104 facing each other, according to an embodiment of the present invention. The tab 108*d* may be an arc head shaped tab, in an embodiment of the present invention. In another embodiment of the present invention, the tab 108*d* may be an oval head shaped tab that may be used to align the step clip fastening device 100 on the surface of the joist, in another embodiment of the present invention. Further, the tab 108*d* may align with the side wall of the joist that may keep the step clip fastening device 100 parallel to a top surface of the joist, in an embodiment of the present invention.

Figure 3A:
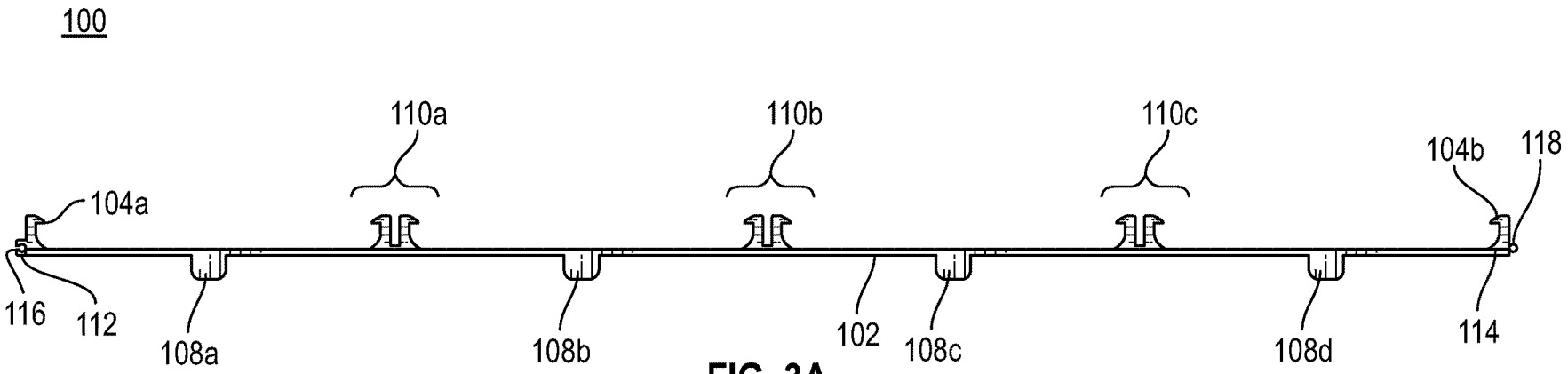
FIG. 3A illustrates a front view of the step clip fastening device, according to an embodiment of the present invention.

FIG. 3A illustrates a front view of the step clip fastening device 100, according to an embodiment of the present invention. The step clip fastening device 100 comprises the plurality of step clips 104*a*-104*b* (interchangeably referred to as the step clips 104) and the plurality of step clip sets 110*a*-110*c*. The step clip 104*a* may be attached to the first end 112 of the base strip 102 and the step clip 104*b* may be attached to the second end 114 of the base strip 102 such that the inner cavity of each of the step clip 104*a* and 104*b* faces each other. Further, the plurality of step clips 104*a* and 104*b* and the plurality of step clip sets 110*a*-110*c* may be attached to the base strip 102 at an equal distance, in an embodiment of the present invention. In another embodiment of the present invention, the distance between the plurality of step clips 104*a* and 104*b* and the plurality of step clip sets 110*a*-110*c* may be variable. Further, each of the plurality of step clip sets 110*a*-110*c* may comprise at least two step clips 104 arranged in a back-to-back configuration, according to embodiments of the present invention. Further, the step clip fastening device 100 comprises the plurality of tabs 108*a*-108*d* (hereinafter referred to as the tab 108) that may extend vertically downwards from the base of the base strip 102. The tab 108 may be an arc shaped tab, in one embodiment of the present invention. In another embodiment of the present invention, the tab 108 may be an oval head shaped tab. Embodiments of the present invention are intended to include or otherwise cover any shape of the tab 108 including known, related art, and/or later developed technologies.

In an embodiment of the present invention, the step clip fastening device 100 may further comprise a female locking part 116 attached to the first end 112 of the base strip 102 and a male locking part 118 attached to a second end 114 of the base strip 102. According to an embodiment of the present invention, the female locking part 116 may be a concave cavity section provided at the first end 112 of the base strip 102 to securely attach a second step clip fastening device 100 in a back-to-back configuration. Further, the male locking part 118 may be a molded protrusion provided at the second end 114 of the base strip 102 that cooperatively engages a female locking part 116 to securely fasten the corresponding step clip fastening device 100. In an embodiment of the present invention, the male locking part 118 of the elongated base strip 102 may be inserted into a female locking part 116 of a second step clip fastening device 100 for increasing the length of the step clip fastening device 100 along a joist.

Figure 3B:
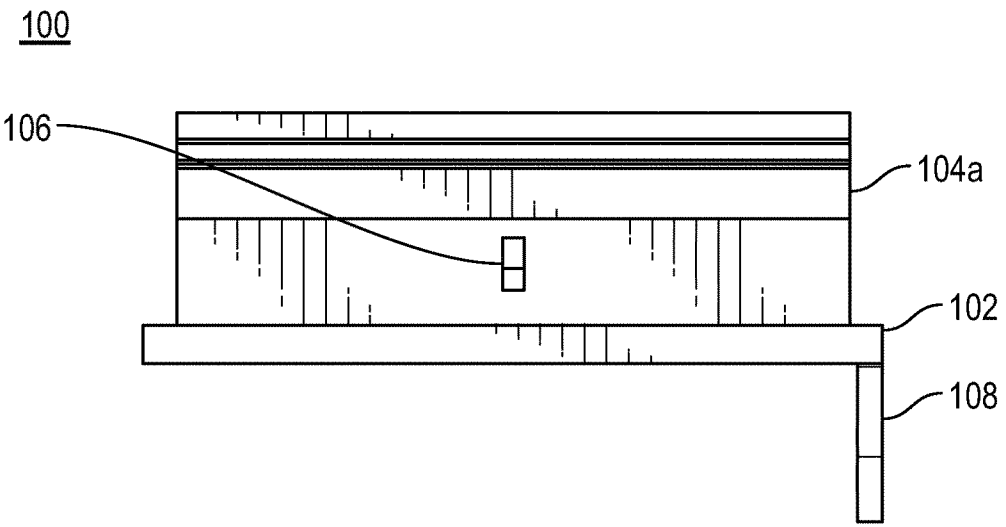
FIG. 3B illustrates a left side view of the step clip fastening device, according to an embodiment of the present invention.

FIG. 3B illustrates a left side view of the step clip fastening device 100, according to an embodiment of the present invention. The step clip fastening device 100 comprises the base strip 102, the step clip 104*a*, the anchor 106, and the tab 108.

In an embodiment of the present invention, the elongated base strip 102 is preferably made up of a glass filled polypropylene, in an embodiment of the present invention. Embodiments of the present invention are intended to include or otherwise cover any material of the base strip 102 including known, related art, and/or later developed technologies that may be beneficial to provide dimensional stability, rigidity and strength to the base strip 102. Further, a width of the base strip 102 may be made slightly greater than a width of the step clip 104*a*, such that the base strip 102 extends over the edges of the surface of the joist, in an embodiment of the present invention. Further, the step clip 104*a* may extend perpendicularly upwards from the base strip 102, in an embodiment of the present invention. Further, one side of the step clip 104*a* may comprise an inner cavity that includes the anchor 106. The anchor 106 may be a small arc shaped protrusion present at a center of the inner cavity of the step clip 104, in an embodiment of the present invention. Embodiments of the present invention are intended to include or otherwise cover any shape of the anchor 106 including known, related art, and/or later developed technologies that may be beneficial to restrict the movement of the deck board (as shown in the FIG. 9A-9C). In an embodiment of the present invention, a size of the anchor 106 may be 1 millimeter (mm). Embodiments of the present invention are intended to include or otherwise cover any of the size of the anchor 106 including known, related art, and/or later developed technologies including known, related art, and/or later developed technologies that may be beneficial to restrict the movement of the deck board. In an embodiment of the present invention, the anchor 106 may be made up of a metal piece such as, but not limited to, a stainless steel. In another embodiment of the present invention, the anchor 106 may be made up of a rubber material. In another embodiment of the present invention, the anchor 106 may be a washer, or a molded protrusion that may be disposed at the inner cavity of the step clip 104*a*. Further, the anchor 106 may be designed to provide enough friction to the deck board and for restricting a movement of the deck board in a horizontal direction.

Further, the tab 108 may be attached to the base strip 102 that may extend substantially perpendicularly downwards from the base strip 102. The tab 108 may be an arc head shaped tab that may be used to align the step clip fastening device 100 on the surface of the joist, in an embodiment of the present invention. In another embodiment of the present invention, the tab 108 may be an oval head shaped tab.

Figure 4A:
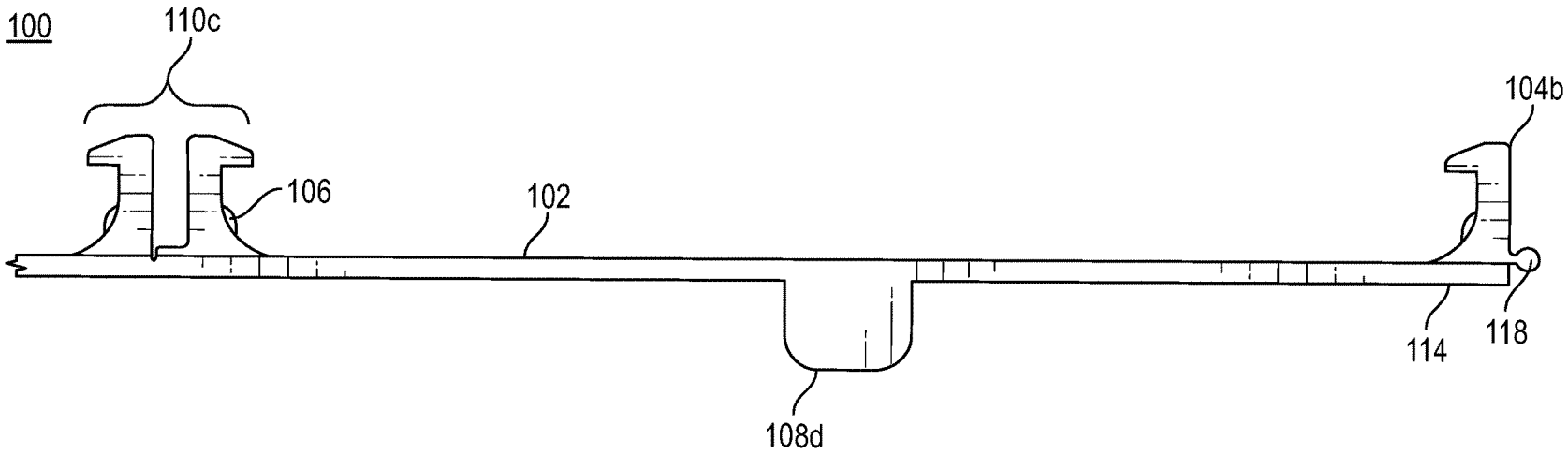
FIG. 4A illustrates an enlarged partial right side of the front view of the step clip fastening device, according to an embodiment of the present invention.

FIG. 4A illustrates an enlarged partial right side of the front view of the step clip fastening device 100, according to an embodiment of the present invention. The step clip 104*b* may be provided that extends perpendicularly upwards from the base strip 102, according to embodiments of the present invention. In an embodiment of the present invention, the step clip set 110*c* may be extending substantially perpendicularly upwards from the base strip 102 of the step clip fastening device 100. Further, the step clip set 110*c* may be made by arranging two step clips 104 in a back-to-back configuration, in an embodiment of the present invention. In an embodiment of the present invention, the anchor 106 may be protruded at a center of each of the step clip 104*b*. Further, the tab 108*d* may be extending substantially perpendicularly downwards from the base strip 102 between the step clip set 110*c* and step clip 104*b* facing each other. In an embodiment of the present invention, the male locking part 118 at the second end 114 of the elongated base strip 102 may be a molded protrusion attached to the second end 114 of the base strip 102, in an embodiment of the present invention.

Figure 4B:
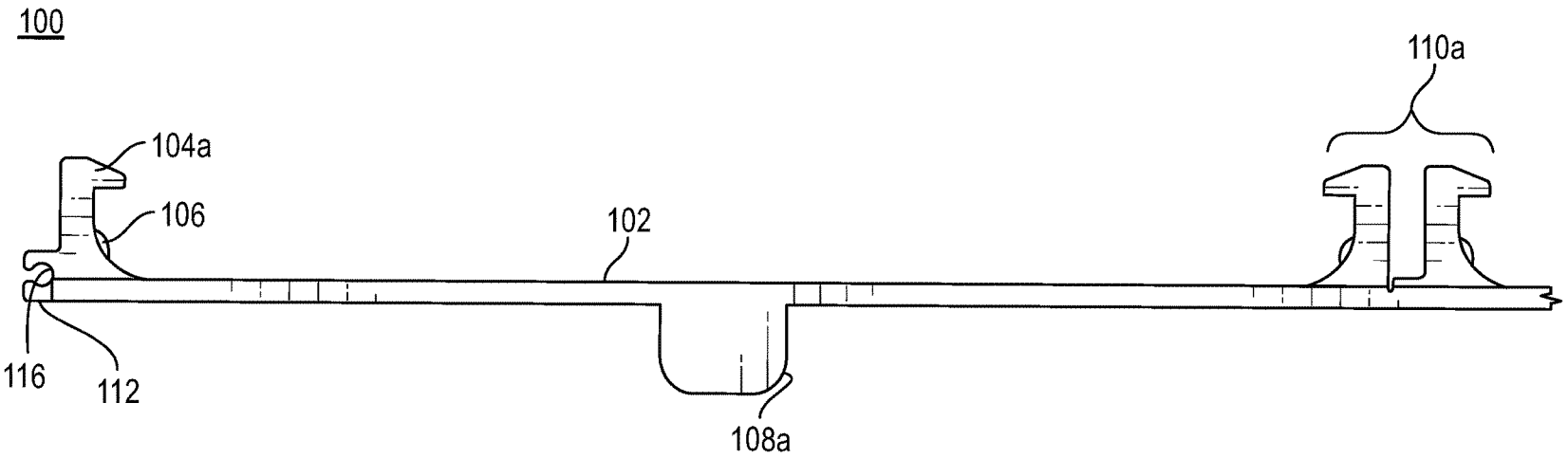
FIG. 4B illustrates an enlarged partial left side of the front view of the step clip fastening device, according to an embodiment of the present invention.

FIG. 4B illustrates an enlarged partial left side of the front view of the step clip fastening device 100, according to an embodiment of the present invention. The step clip fastening device 100 comprises the base strip 102 preferably made up of a glass filled polypropylene, in an embodiment of the present invention. Further, the step clip 104*a* extending perpendicularly upwards from the base strip 102 may be attached to the first end 112 of the base strip 102. In an embodiment of the present invention, the step clip set 110*a* may be extending substantially perpendicularly upwards from the base strip 102 of the step clip fastening device 100. Further, the step clip set 110*a* may be made by arranging two step clips 104 in a back-to-back configuration, in an embodiment of the present invention. In an embodiment of the present invention, the anchor 106 may be protruded at a center of each of the step clip 104*a* and the step clip 104 of the step clip set 110*a*. Further, the tab 108*a* may be extending substantially perpendicularly downwards from the base strip 102 between the step clip set 110*a* and step clip 104*a* facing each other. In an embodiment of the present invention, the female locking part 116 at the first end 112 of the elongated base strip 102 may be a concave cavity section attached to the first end 112 of the base strip 102, in an embodiment of the present invention.

Figure 5:
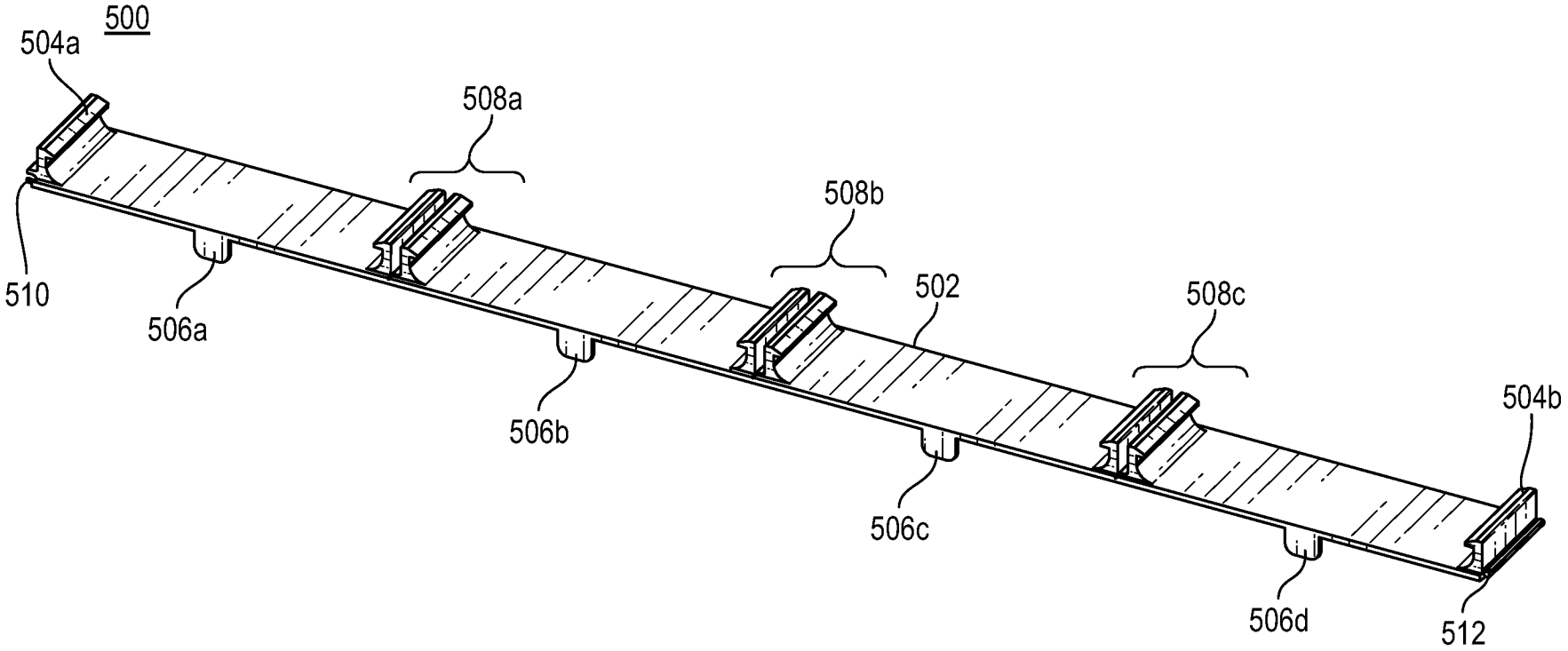
FIG. 5 illustrates a perspective view of a step clip fastening device, according to another embodiment of the present invention.

FIG. 5 illustrates a perspective view of a step clip fastening device 500, according to another embodiment of the present invention. The step clip fastening device 500 comprises an elongated base strip 502, a plurality of step clips 504*a*-504*b* (interchangeably referred to as the step clip 504), a plurality of tabs 506*a*-506*d* (hereinafter referred to as the tab 506), and a plurality of step clip sets 508*a*-508*c* (hereinafter referred to as the step clip set 508). In an embodiment of present invention, the base strip 502 of the step clip fastening device 500 may be an elongated base strip made up of a material such as, but not limited to, a plastic, a synthetic rubber, a natural rubber, and so forth. In a preferred embodiment of present invention, the base strip 502 may be made up of a glass filled polypropylene. Embodiments of the present invention are intended to include or otherwise cover any material of the base strip 502 including known, related art, and/or later developed technologies that may be beneficial to provide dimensional stability, rigidity and strength to the base strip 502. In an embodiment of the present invention, a width of the base strip 502 may be made slightly greater than a width of the step clip 504 such that the slightly greater width of the base strip 502 may enable the base strip 502 to extend over an edge of a surface of a joist (not shown), according to an embodiment of the present invention.

Further, the step clip 504 may be designed such that the step clip 104 extends substantially perpendicularly upwards from the base strip 502 of the step clip fastening device, in an embodiment of the present invention. Further, the step clip 504 may comprise an inner cavity at one side and a flat vertical surface on an opposite side, according to embodiments of the present invention. According to embodiments of the present invention, the step clip 504*a* may be attached to a first end 510 of the base strip 502 and the step clip 504*b* may be attached a second end 512 of the base strip 502.

In an embodiment of the present invention, the step clip set 508 may be designed to extend substantially perpendicularly upwards from the base strip 502 of the step clip fastening device 500. Further, the step clip set 508 may be provided along a length of the elongated base strip 502, according to an embodiment of the present invention. In an embodiment of the present invention, the step clip set 508 may be arranged along a length of the base strip 502 at an equal distance between the step clip 504*a* and the step clip 504*b*. In another embodiment of the present invention, the step clip set 508 may be arranged along the length of the base strip 502 at a variable distance between the step clip 504*a* and the step clip 504*b*. Furthermore, the step clip set 508 may comprise two step clips 504 arranged in a back-to-back configuration, according to embodiments of the present invention. According to an embodiment of the present invention, the step clip fastening device 100 may comprise at least three step clip sets 508 arranged on the base strip 502 between the step clip 504*a* attached to the first end 510 of the base strip 502 and the step clip 504*b* attached to the second end 512 of the base strip 502. In an embodiment of the present invention, the step clip 504*a* and the step clip 504*b* may be attached to the base strip 502 such that the inner cavity of the step clip 504*a* faces the inner cavity of the step clip 504*b*.

According to embodiments of the present invention, the step clip fastening device 500 comprises the tab 506 that may extend substantially perpendicularly downwards from the base strip 502 between two adjacent step clips 504 facing each other. The tab 506 may be an arc head shaped tab that may be used to align the step clip fastening device 500 on a surface of the joist, in an embodiment of the present invention. In another embodiment of the present invention, the tab 506 may be an oval head shaped tab. Further, the tab 506 may be designed to align with a side wall of the joist and may keep the step clip fastening device 500 parallel to the surface of the joist for quick and efficient installation, according to embodiments of the present invention.

Figure 6:
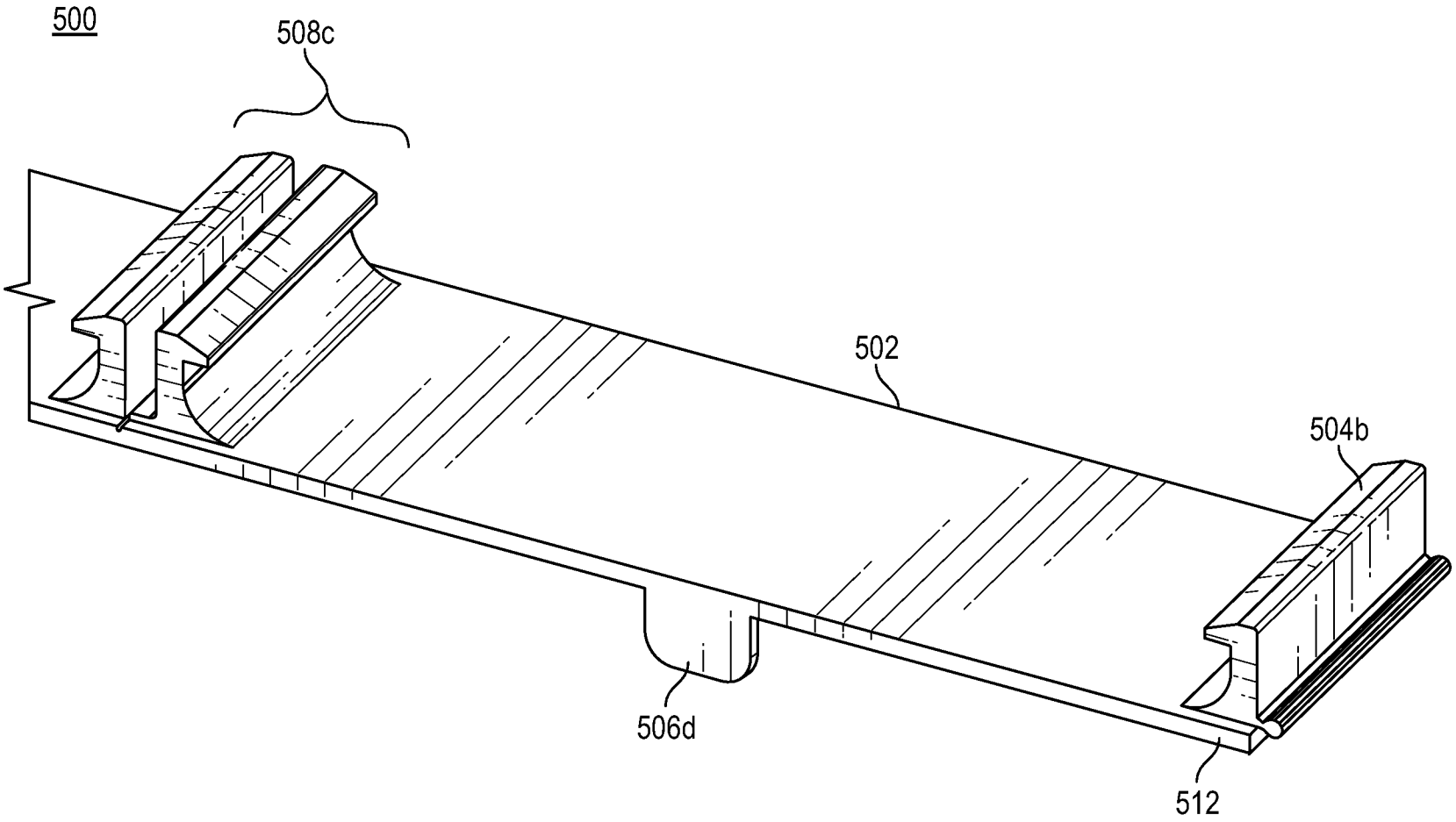
FIG. 6 illustrates an enlarged partial view of the step clip fastening device, according to another embodiment of the present invention.

FIG. 6 illustrates an enlarged partial view of the step clip fastening device 500, according to an embodiment of the present invention. The step clip fastening device 500 comprises the elongated base strip 502, the step clip 504*b* attached to the second end 512 of the base strip 502, and the tab 506*d*. In an embodiment of the present invention, the width of the base strip 502 may be slightly greater than the width of the step clip set 508*c*, such that the base strip 502 extends over the edges of the surface of the joist. The step clip 504*b* may be attached at the second end 512 of the base strip 502, according to embodiments of the present invention. The step clip 504*b* and step clip set 508*c* may be provided along the length of the base strip 502, according to embodiments of the present invention. Further, the step clip set 508*c* may be designed to extend substantially perpendicularly upwards from the base strip 502, according to embodiments of the present invention. According to embodiments of the present invention, the step clip set 508*c* comprises at least two step clip 504 arranged in a back-to-back configuration.

Further, the step clip fastening device 500 comprises the tab 506*d* that extends substantially perpendicularly downwards from the base strip 502 between two corresponding step clips 504 facing each other. The tab 506*d* may be an arc head shaped tab, in an embodiment of the present invention. In another embodiment of the present invention, the tab 506*d* may be an oval head shaped tab that may be used to align the step clip fastening device 500 on the surface of the joist, in another embodiment of the present invention. The tab 506*d* may align with the side wall of the joist that may keep the step clip fastening device 500 parallel to a top surface of the joist, in an embodiment of the present invention.

Figure 7A:
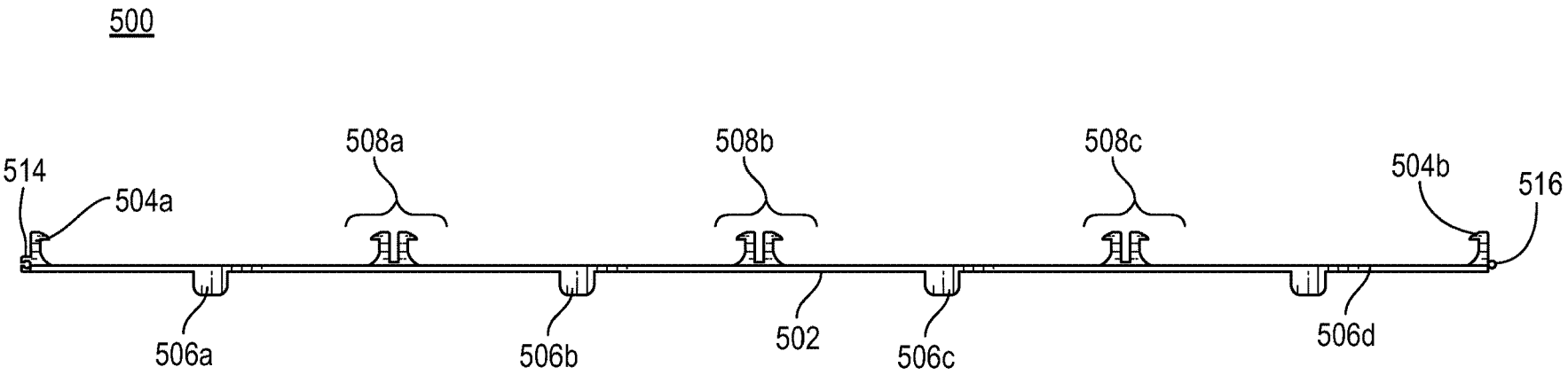
FIG. 7A illustrates a front view of the step clip fastening device, according to another embodiment of the present invention.

FIG. 7A illustrates a front view of the step clip fastening device 500, according to an embodiment of the present invention. The step clip fastening device 500 comprises the step clips 504 and the step clip sets 508. Further, the step clip fastening device 500 comprises the tabs 506 that may extend vertically downwards from the base of the base strip 502. The tab 506 may be an arc shaped tab, in one embodiment of the present invention. In another embodiment of the present invention, the tab 506 may be an oval head shaped tab. Embodiments of the present invention are intended to include or otherwise cover any shape of the tab 506 including known, related art, and/or later developed technologies. According to embodiment of the present invention, the step clips 504 and the step clip set 508 may be attached to the base strip 502 at an equal distance, in an embodiment of the present invention. In another embodiment of the present invention, the distance between the corresponding step clips 504 and the step clip set 508 may be variable. Further, the step clip set 508 may comprise at least two step clips 504 that may be arranged in a back-to-back configuration, according to embodiments of the present invention.

In an embodiment of the present invention, the step clip fastening device 500 may further comprise a female locking part 514 attached to the first end 510 of the base strip 502 and a male locking part 516 attached to the second end 512 of the base strip 502. The female locking part 514 may be a concave cavity section provided of the base strip 502 to securely attach a second step clip fastening device 500 in a back-to-back configuration. The male locking part 516 may be a molded protrusion of the base strip 502 that cooperatively engages a female locking part 514 to securely fasten the corresponding step clip fastening device 500. In an exemplary scenario, the male locking part 516 of the base strip 502 may be inserted into a female locking part 514 of a second step clip fastening device 500 for increasing the length of the step clip fastening device 500 along a joist.

Figure 7B:
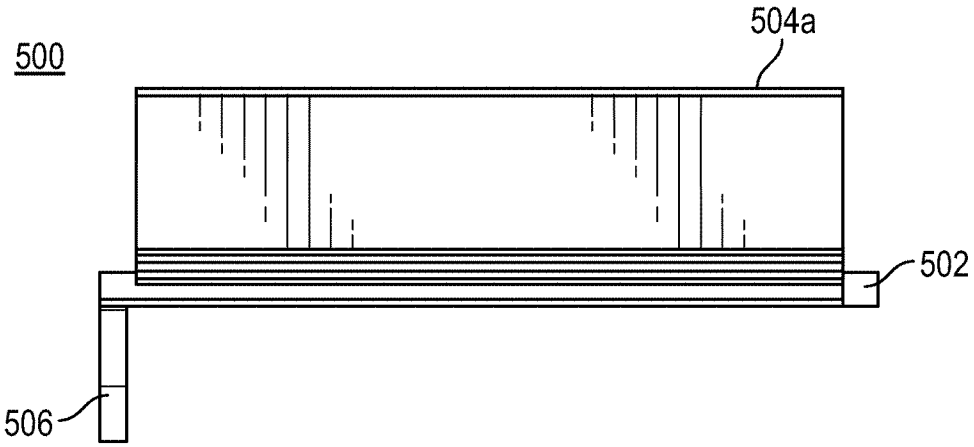
FIG. 7B illustrates a left side view of the step clip fastening device, according to another embodiment of the present invention.

FIG. 7B illustrates a left side view of the step clip fastening device 500, according to an embodiment of the present invention. The step clip fastening device 500 comprises the base strip 502, the step clip 504*a*, and the tab 506. In an embodiment of the present invention, the base strip 502 may be preferably made up of a glass filled polypropylene, in an embodiment of the present invention. Further, a width of the base strip 502 may be made slightly greater than a width of the step clip 104*a* such that the base strip 502 extends over the edges of the surface of the joist, in an embodiment of the present invention. Further, the step clip 504*a* may extend perpendicularly upwards from the base strip 502, in an embodiment of the present invention. Further, the tab 506 may be attached to the base strip 502 that may extend substantially perpendicularly downwards from the base strip 502. The tab 506 may be an arc head shaped that may be used to align the step clip fastening device 500 on the surface of the joist, in an embodiment of the present invention. In another embodiment of the present invention, the tab 506 may be an oval head shaped tab.

Figure 8A:
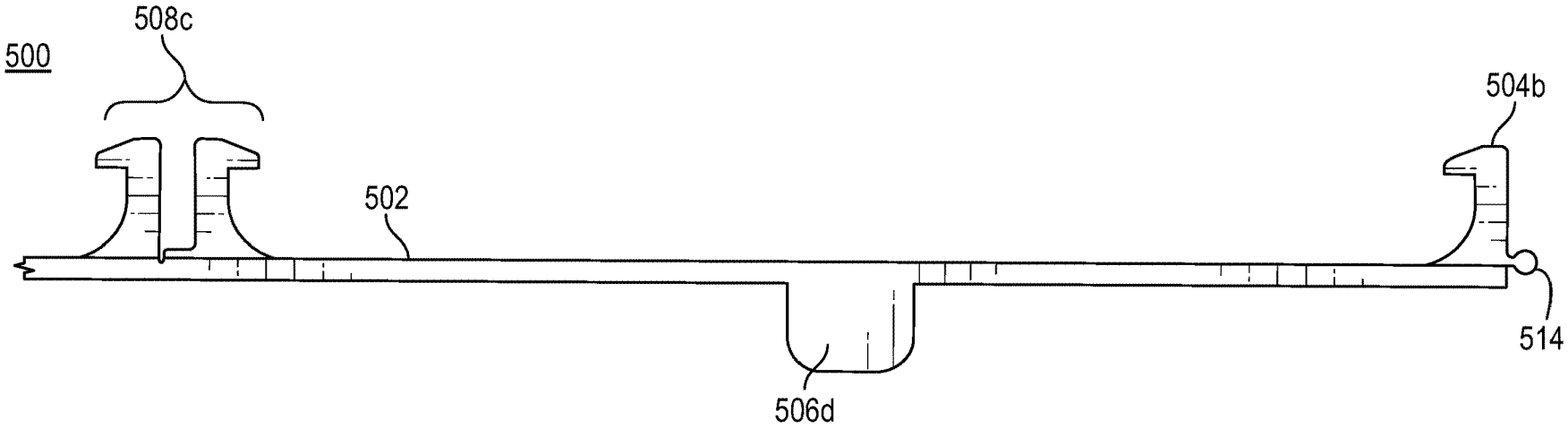
FIG. 8A illustrates an enlarged partial right side of the front view of the step clip fastening device, according to another embodiment of the present invention.

FIG. 8A illustrates an enlarged partial right side of the front view of the step clip fastening device 500, according to an embodiment of the present invention. The step clip fastening device 500 comprises the base strip 502 preferably made up of a glass filled polypropylene, in an embodiment of the present invention. Further, the step clip 504*b* extending perpendicularly upwards from the base strip 502. In an embodiment of the present invention, the step clip set 508*c* may be extending substantially perpendicularly upwards from the base strip 502 of the step clip fastening device 500. Further, the step clip set 508*c* may be made by arranging two step clips 504 in a back-to-back configuration, in an embodiment of the present invention. Further, the step clip fastening device 500 comprises the tab 506*d* that is extending substantially perpendicularly downwards from the base strip 502 between the step clip set 508*c* and step clip 504*b* facing each other. In an embodiment of the present invention, the male locking part 514 of the base strip 502 may be a molded protrusion attached to the first end 510 of the base strip 502.

Figure 8B:
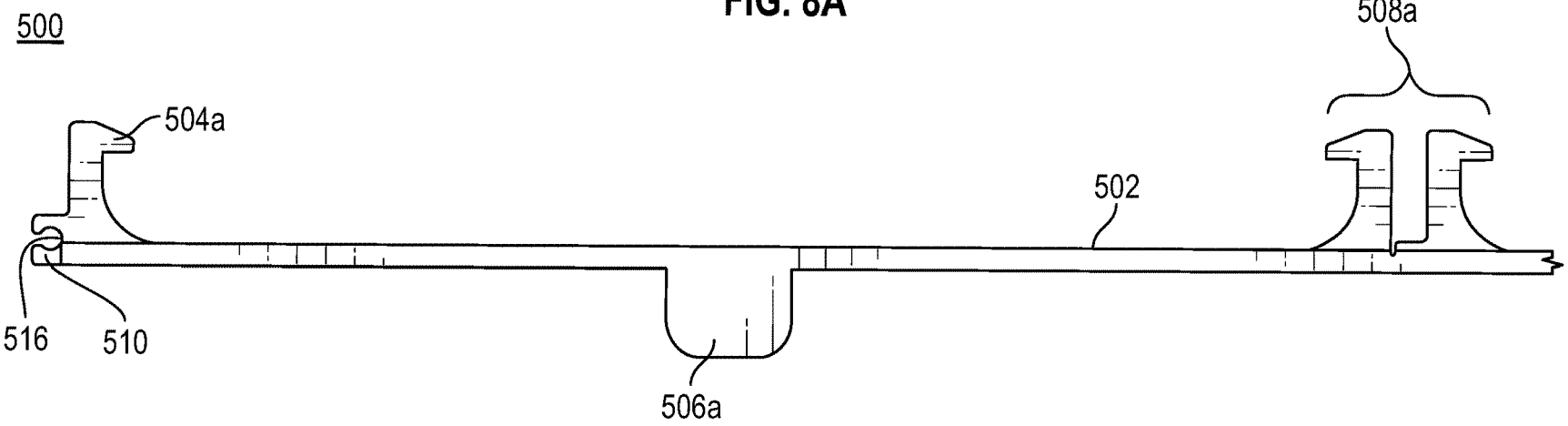
FIG. 8B illustrates an enlarged partial left side of the front view of the step clip fastening device, according to another embodiment of the present invention.

FIG. 8B illustrates an enlarged partial left side of the front view of the step clip fastening device 500, according to an embodiment of the present invention. The step clip fastening device 500 comprises the base strip 502 preferably made up of a glass filled polypropylene, in an embodiment of the present invention. Further, the step clip 504*a* extending perpendicularly upwards from the base strip 502, according to an embodiment of the present invention. In an embodiment of the present invention, the step clip set 508*a* may be extending substantially perpendicularly upwards from the base strip 102 of the step clip fastening device 500. Further, the step clip set 508*a* may be made by arranging two step clips 504 in a back-to-back configuration, in an embodiment of the present invention. Further, the tab 506*a* may be extending substantially perpendicularly downwards from the base strip 502 between the step clip set 508*a* and step clip 504*a* facing each other. In an embodiment of the present invention, the female locking part 516 of the base strip 502 may be a concave cavity section provided at the first end 510 of the base strip 502.

FIGS. 9A to 9C illustrate a deck board fastening system 900 in which a deck board 902 is snapped into the step clip fastening device 100, according to an embodiment of the present invention. The deck board fastening system 900 may comprise a deck board 902 comprising an upper surface 904, a lower surface 906 and the step clip fastening device 100. In an embodiment of the present invention, the lower surface 906 may be a protruded lower surface. In another embodiment of the present invention, the lower surface 906 may be a flat surface. In an embodiment of the present invention, the step clip fastening device 100 may comprise the base strip 102 preferably made up of a glass filled polypropylene, in an embodiment of the present invention. In an embodiment of the present invention, a width of the base strip 102 is made slightly greater than a width of the step clip set 110*a*, such that the base strip 102 extends over the edges of the surface of the joist. This is done to protect the joist surface from water damage, rot, decay, which further eliminates the need of using a protection taping for the joist surface. In an embodiment of the present invention, the step clip set 110*a* may be extending substantially perpendicularly upwards from the base strip 102. The step clip set 110*a* may be made by arranging two step clips 104 in a back-to-back configuration, in an embodiment of the present invention.

In an embodiment of the present invention, the each of the step clip set 110*a* may comprise the anchor 106 (as shown in FIG. 913) protruded at the center that may be a small arc shaped protrusion disposed at the inner cavity of the step clip set 110*a*, as discussed above. The anchor 106 may be removably attached to the inner cavity of each of the step clips, in an embodiment of the present invention. In another embodiment of the present invention, the anchor 106 may be made up of a metal piece such as, but not limited to, a stainless steel or any other such material known to a person skilled in the art.

In another embodiment of the present invention, the anchor 106 may be replaced with a rubber like material or any other such material that may be over-molded on the inner side surface of the step clip 104. In another embodiment of the present invention, the anchor 106 may be a washer, or a molded protrusion disposed at the inner cavity of the step clip set 110*a*. The anchor 106 provide enough friction to the inner side surface of the step clip set 110*a* and the surface of the deck board 902, which further restricts the movement of the deck board 902 in a horizontal direction between the corresponding step clip set 110*a*. Further, the anchor 106 may provide enough friction to deck board 902 and restrict the movement of the deck board 902 in the horizontal direction, in an embodiment of the present invention.

Further, the step clip fastening device 100 comprises of the tab 108*b* extending substantially perpendicularly downwards from the base strip 102 between two corresponding step clip sets 110 facing each other. The tab 108*b* may be an arc head shaped tab that may be used to align the step clip fastening device 100 on a surface of the joist, in an embodiment of the present invention. According to embodiments of the present invention, the lower surface 906 of the deck board 902 comprises a plurality of cavities. In another embodiment of the present invention, the lower surface 906 of the deck board 902 may be a flat surface. The deck board 902 further comprises at each end, a lower lip 908 and an upper lip 910, that may define a portion of a groove in between the lower lip 908 and the upper lip 910.

FIG. 9B illustrates the deck board 902 partially installed into the step clip fastening device 100, according to embodiments of the present invention. One end of the deck board 902 may be inserted into the step clip set 110*b* and the other end of the deck board 902 is pressed against the top surface of a corresponding step clip set 110*a*. The step clip fastening device 100 fits into the groove of the deck board 902. Further, the anchor 106 may dig into the bottom of the deck board 902, when the deck board 902 is snapped into the step clip set 110*a* of the step clip fastening device 100, in an embodiment of the present invention. The anchor 106 may deform the bottom of the deck board 902 that may restrict the movement of the deck board while it is snapped into the step clip fastening device 100, and even after it is installed. Therefore, the anchor 106 may eliminate a need of extra wooden boards and fastening means installed at the perimeter of a deck for holding the deck board 902 between the corresponding step clip sets 110.

FIG. 9C illustrates the deck board 902 completely snapped into the step clip fastening device 102, according to an embodiment of the present invention. The deck board 902 may be pressed against the step clip fastening device 100 as discussed above.

Figure 10:
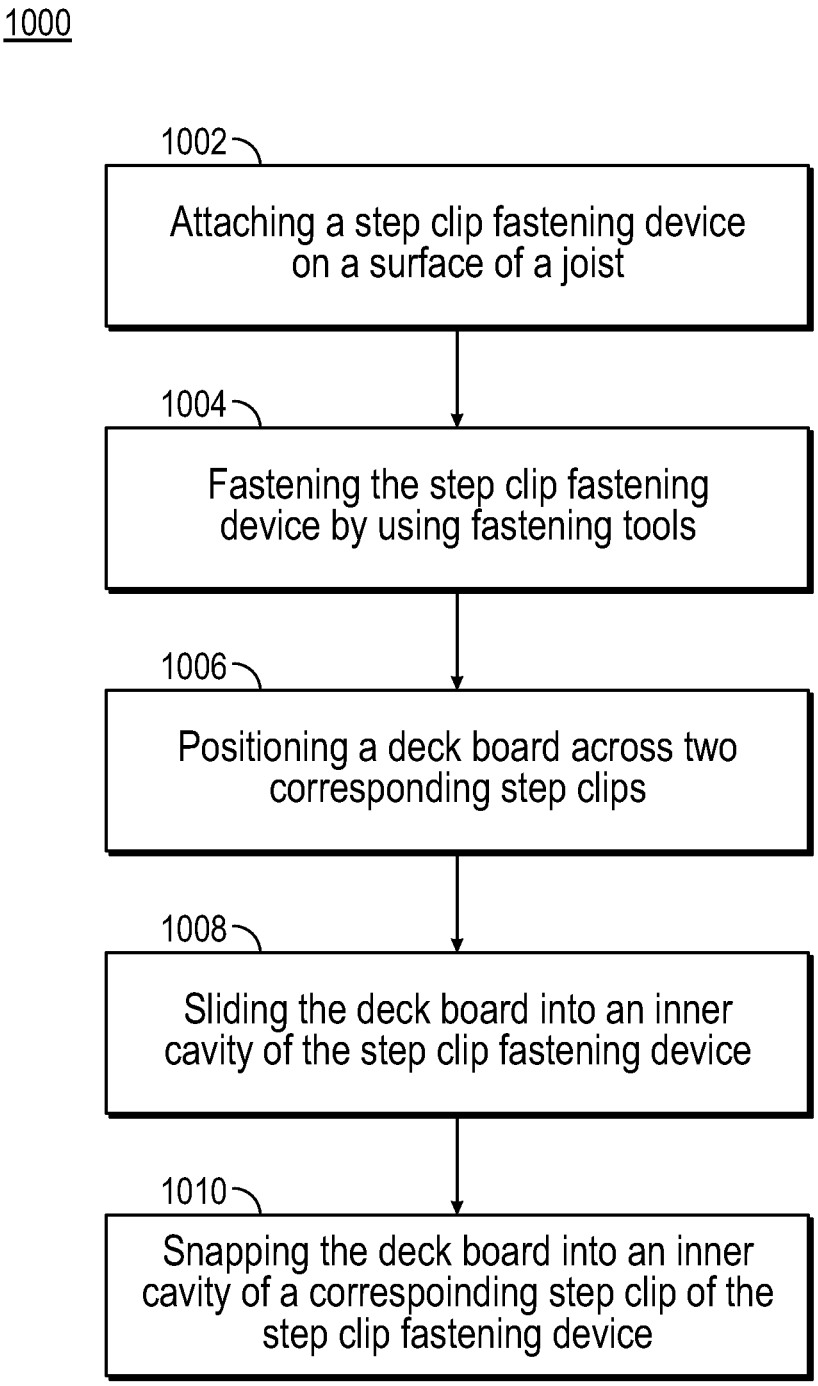
FIG. 10 illustrates a method of assembling the deck board by using the step clip fastening device, according to an embodiment of the present invention.

FIG. 10 illustrates a method 1000 of assembling the deck board 902 by using the step clip fastening device 100, according to an embodiment of the present invention.

At step 1002, the step clip fastening device 100 is rigidly attached on a surface of a joist. As discussed above, the step clip fastening device 100 comprises the elongated base strip 102, the step clip 104, the step clip set 110, the anchor 106, and the tab 108. Each tab 108 of the step clip fastening device 100 may be positioned along a side surface of the joist. Further, as discussed, the tab 108 may be arc head shaped, which may be used to align the step clip fastening device 100 on the surface of the joist, in an embodiment of the present invention.

At step 1004, the step clip fastening device 100 may be fastened on the joist by using one more fastening tools (not shown). The joist employs cooperating installation fastening tools for joining or interconnecting a plurality of deck boards.

At step 1006, the deck board 902 may be positioned across two corresponding step clips 104 of the step clip fastening device 100, such that an inner cavity of each of the step clip 104 faces each other.

At step 1008, a first end of the deck board 902 may slide into an inner cavity of the step clip 104 of the step clip fastening device 100 such that the step clip fastening device 100 is engaged within the groove of the deck board 902.

At step 1010, a second end of the deck board 902 may be snapped into an inner cavity of a corresponding step clip 104 of the step clip fastening device 100 to form a mating relationship between the deck board 902 and the step clip fastening device 100. The mating relationship between the deck board and the step clip fastening device 100 is formed through the anchor 106 that protrudes at the center of each of the step clip 104 of the step clip fastening device 100. The anchor 106 may dig into a bottom surface of the deck board 902.

Figure 11A:
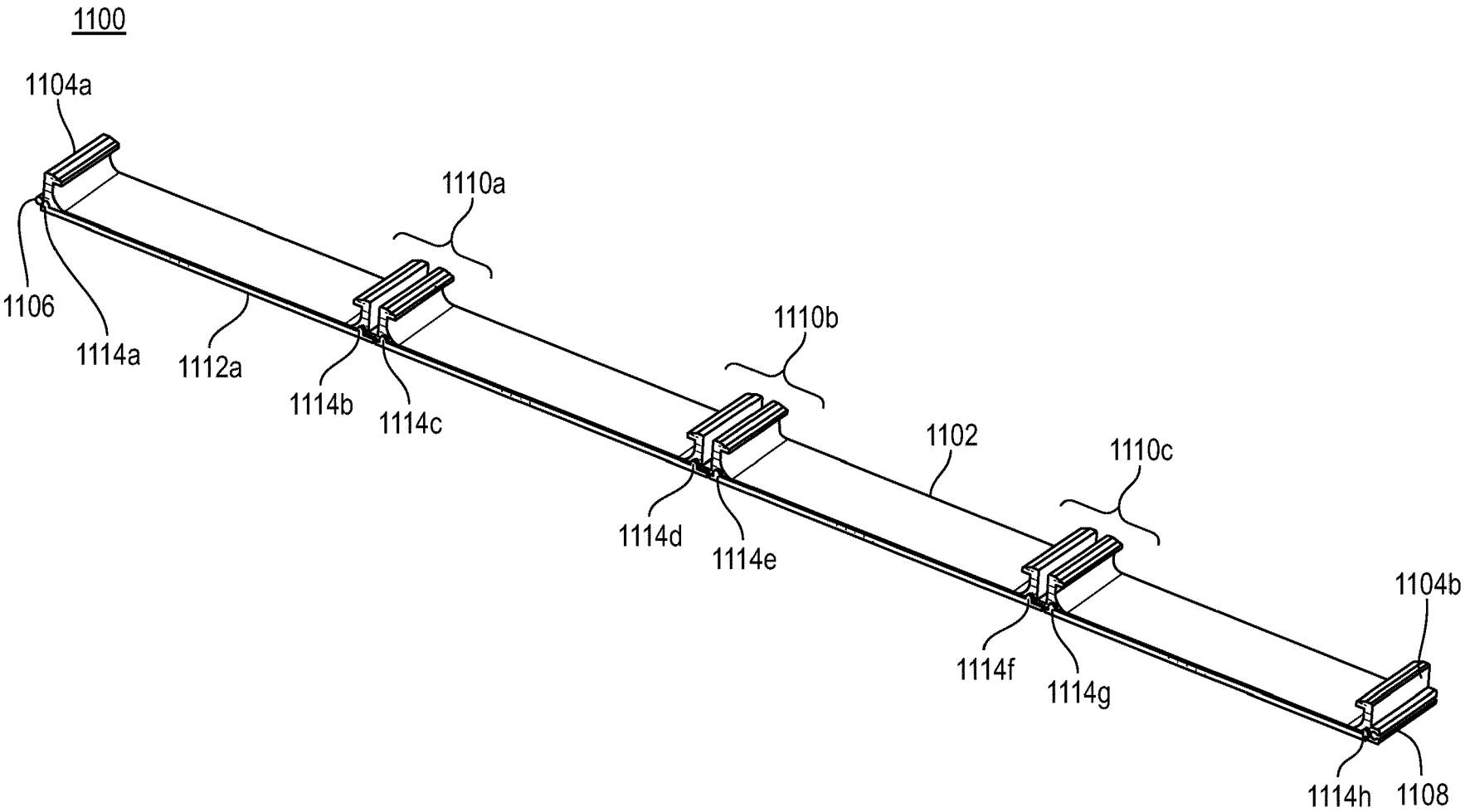
FIG. 11A illustrates a right perspective view of a step clip fastening device, device, according to an alternate embodiment of the present invention.

FIG. 11A illustrates a right perspective view of a step clip fastening device 1100, according to an alternate embodiment of the present invention. The step clip fastening device 1100 comprises an elongated base strip 1102, a step clip 1104*a* attached to a first end 1106 of the base strip 1102, a step clip 1104*b* attached to a second end 1108 of the base strip 1102, and a plurality of step clip sets 1110*a*-1110*c* (hereinafter referred to as the step clip set 1110).

In an embodiment of present invention, the base strip 1102 may be made up of a material such as, but not limited to, a plastic, a synthetic rubber, a natural rubber, and so forth. In a preferred embodiment of present invention, the base strip 1102 may be made up of a glass filled polypropylene material. Embodiments of the present invention are intended to include or otherwise cover any of the material for the base strip 1102 including known, related art, and/or later developed technologies that may be beneficial to provide dimensional stability, rigidity and strength to the base strip 1102. Further, a shape of the base strip 1102 may be, but not limited to, a cylindrical shape, a square shape, a rectangular shape, and so forth. Embodiments of the present invention are intended to include or otherwise cover any of the shape for the base strip 1102 including known, related art, and/or later developed technologies. According to embodiments of the present invention, the step clip 1104*a* and the step clip 1104*b* may be designed to extend substantially perpendicularly upwards from a surface the base strip 1102. Further, one side of the step clip 1104*a* and the step clip 1104*b* may comprise an inner cavity and an opposite side of the step clip 1104*a* and the step clip 1104*b* may comprise a flat vertical surface, according to embodiments of the present invention. According to an embodiment of the present invention, a width of the base strip 1102 may be made slightly greater than a width of the plurality of step clips 1104*a* and 1104*b* such that the slightly greater width of the base strip 1102 enables the base strip 1102 to extend over an edge of a surface of a joist, according to an embodiment of the present invention.

In an embodiment of the present invention, the step clip set 1110 may be made by arranging two identical step clips 1104 in a back-to-back configuration. Further, the step clip set 1110 may be provided along a length of the base strip 1102 extending substantially perpendicularly upwards from the surface the base strip 1102, according to embodiments of the present invention. According to embodiments of the present invention, each of the step clips of the step clip set 1110 may comprise an inner cavity at one side and a flat vertical surface on an opposite side of each of the step clips. According to an embodiment of the present invention, the step clip fastening device 1100 may comprise at least three step clip sets 1110 arranged on the base strip 1102 between the step clip 1104*a* attached to the first end 1106 of the base strip 1102 and the step clip 1104*b* attached to the second end 1108 of the base strip 1102. In an embodiment of the present invention, the step clip 1104*a* and the step clip 1104*b* may be attached to the base strip 1102 such that the inner cavity of the step clip 1104*a* faces the inner cavity of the step clip 1104*b*.

According to an embodiment of the present invention, the step clip sets 1110 may be arranged along the length of the base strip 1102 at an equal distance between the step clips 1104*a* and 1104*b*. In another embodiment of the present invention, the step clip sets 1110 may be arranged along the length of the base strip 1102 at a variable distance between the step clips 1104*a* and 1104*b*. Further, the step clip 1104*a*, the step clip 1104*b* and the step clip sets 1110 may be made up of a material such as, but not limited to, a plastic, a synthetic rubber, a natural rubber, and so forth. In a preferred embodiment of present invention, the step clip 1104*a*, the step clip 1104*b* and the step clip sets 1110 may be made up of a glass filled polypropylene material. Embodiments of the present invention are intended to include or otherwise cover any of the material for the step clip 1104*a*, the step clip 1104*b* and the step clip sets 1110 including known, related art, and/or later developed technologies that may be beneficial to provide dimensional stability, rigidity and strength to the step clip 1104*a*, the step clip 1104*b* and the step clip sets 1110.

Further, the base strip 1102 may comprise a plurality of hooks 1114*a*-1114*h* (hereinafter referred to as the hooks 1114) that may be provided on a left side surface of the base strip 1102 near a bottom of each of the step clip sets 1110, the step clip 1104*a* and the step clip 1104*b*, according to an embodiment of the present invention. The hooks 1114 may be protrusions that may be integrally designed with the base strip 1102 in an embodiment of the present invention. In another embodiment of the present invention, the hooks 1114 may be removably attached with the base strip 1102. Further, the hooks 1114 may be designed to hold a cover strip 1112*a* that may be attached upon the left side surface of the base strip 1102, in an embodiment of the present invention. The cover strip 1112*a* may be made up of a material such as but not limited to, a natural rubber, a synthetic rubber, a plastic, a fabric, and so forth. Embodiments of the present invention are intended to include or otherwise cover any of the material for the cover strip 1112*a* including known, related art, and/or later developed technologies. Further, a width of the cover strip 1112*a* may be such that the cover strip 1112*a* completely covers the left side surface of the base strip 1102, according to an embodiment of the present invention.

Figure 11B:
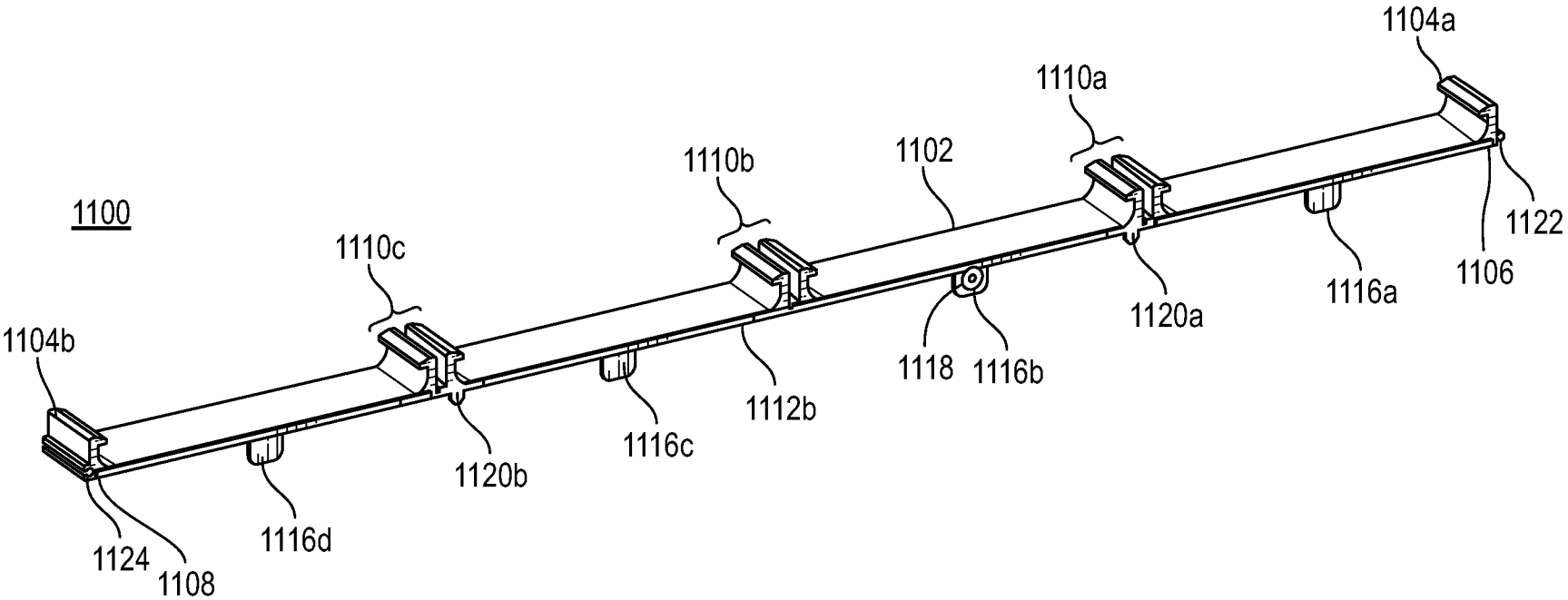
FIG. 11B illustrates a left side perspective view of the step clip fastening device, according to the alternate embodiment of the present invention.

FIG. 11B illustrates a left side perspective view of the step clip fastening device 1100, according to an alternate embodiment of the present invention. The step clip fastening device 1100 comprises the elongated base strip 1102, the step clip 1104*a* attached to the first end 1106 of the base strip 1102, the step clip 1104*b* attached to the second end 1108 of the base strip 1102, and the clip sets 1110, as discussed in FIG. 11A. According to an embodiment of the present invention, the step clip fastening device 1100 further comprises a plurality of protrusions 1120*a*-1120*b* (hereinafter referred to as the protrusions 1120) attached to the base strip 1102 near the bottom surface of the every alternate step clip sets 1110. The protrusions 1120 may be integrally designed with the base strip 1102 in an embodiment of the present invention. The step clip fastening device 1100 further comprises a cover strip 1112*b* attached to a right side surface of the base strip 1102, according to an embodiment of the present invention. Further, the cover strip 1112*b* may be made up of a material such as but not limited to, a natural rubber, a synthetic rubber, a plastic, a fabric, and so forth. Embodiments of the present invention are intended to include or otherwise cover any of the material for the cover strip 1112*b* including known, related art, and/or later developed technologies. Furthermore, a width of the cover strip 1112*b* may be such that the cover strip 1112*b* completely covers the right side surface of the base strip 1102, according to an embodiment of the present invention. In an embodiment of the present invention, the cover strip 1112*b* may be attached to the right side surface of the base strip 1102 excluding a space on the right side surface of the base strip 1102 where the protrusions 1120 is attached to the base strip 1102.

According to embodiments of the present invention, the step clip fastening device 1100 further comprises a male locking part 1122 attached to the first end 1106 of the base strip 1102 and a female locking part 1124 attached to the second end 1108 of the base strip 1102. According to embodiments of the present invention, the female locking part 1124 may be a concave cavity integrally made with the base strip 1102 to securely attach a second step clip fastening device 1100 in a back-to-back configuration. Further, the male locking part 1122 may be a molded protrusion integrally made with the base strip 1102 that cooperatively engages a female locking part 1124 to securely fasten the corresponding step clip fastening device 1100, according to embodiment of the present invention. According to embodiments of the present invention, the step clip fastening device 1100 comprises a plurality of tabs 1116*a*-1116*d* extending substantially perpendicularly downwards from the base strip 1102 between two corresponding step clips 1110 facing each other. Further, the plurality of tabs 1116*a*-1116*d* may be an arc head shaped tab that may be used to align the step clip fastening device 1100 on a surface of a joist, according to embodiments of the present invention. In another embodiment of the present invention, the plurality of tabs 1116*a*-1116*d* may be an oval head shaped tab. Further, the plurality of tabs 1116*a*-1116*d* may be designed to enable the step clip fastening device 1100 to be aligned with a side wall of the joist and may keep the step clip fastening device 1100 parallel to a top surface of the joist for quick and efficient installation. According to an embodiment of the present invention, at least one of the plurality of tabs 1116*a*-1116*d* of the step clip fastening device 1100 may comprise a cut-out 1118 that may be provided to significantly decrease a stiffness of the tabs 1116. In a preferred embodiment of the present invention, the cut-out 1118 may be provided in the tab 1116*b* of the plurality of tabs 1116*a*-1116*d*.

Figure 11C:
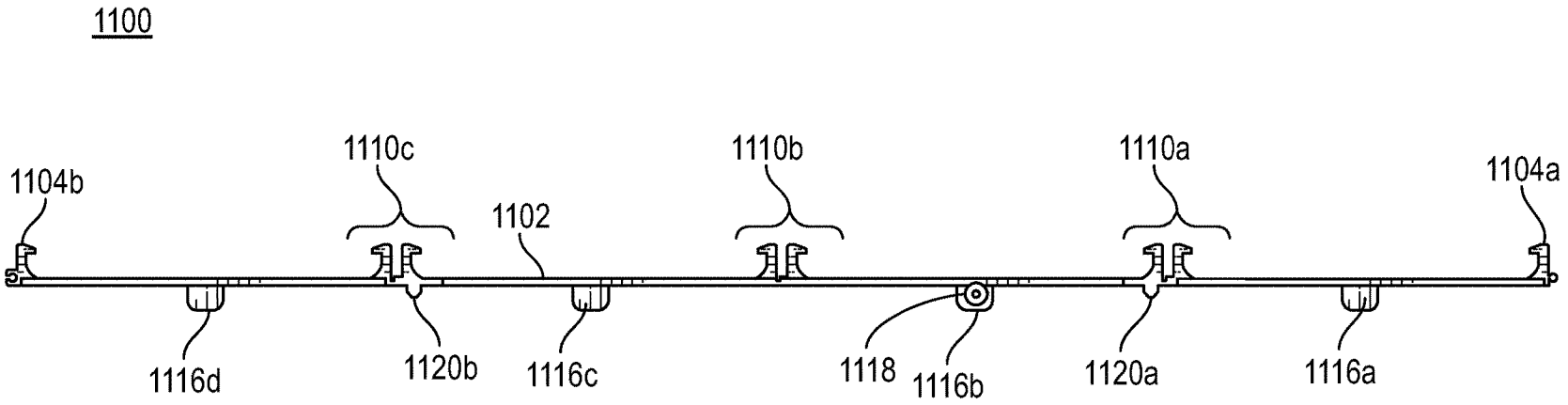
FIG. 11C illustrates a front view of the step clip fastening device, according to the alternate embodiment of the present invention.

FIG. 11C illustrates a front view of the step clip fastening device 1100, according to an alternate embodiment of the present invention. The step clip fastening device 1100 comprises the elongated base strip 1102, the step clip 1104*a* attached to the first end 1106 of the base strip 1102, the step clip 1104*b* attached to the second end 1108 of the base strip 1102, and the clip sets 1110, as discussed in FIG. 11A. According to an embodiment of the present invention, the step clip fastening device 1100 further comprises the protrusions 1120 attached to the base strip 1102 near the bottom surface of the every alternate step clip sets 1110. The protrusions 1120 may be integrally designed with the base strip 1102, in an embodiment of the present invention.

According to embodiments of the present invention, the step clip fastening device 1100 comprises the plurality of tabs 1116*a*-1116*d* extending substantially perpendicularly downwards from the base strip 1102 between two corresponding step clips 1110 facing each other. Further, the plurality of tabs 1116*a*-1116*d* may be an arc head shaped tab that may be used to align the step clip fastening device 1100 on a surface of a joist, according to embodiments of the present invention. In another embodiment of the present invention, the plurality of tabs 1116*a*-1116*d* may be an oval head shaped tab. Further, the plurality of tabs 1116*a*-1116*d* may be designed to enable the step clip fastening device 1100 to be aligned with a side wall of the joist and may keep the step clip fastening device 1100 parallel to a top surface of the joist for quick and efficient installation. According to an embodiment of the present invention, at least one of the plurality of tabs 1116*a*-1116*d* of the step clip fastening device 1100 may comprise a cut-out 1118 that may be provided to significantly decrease a stiffness of the tabs 1116*a*-1116*d*. In a preferred embodiment of the present invention, the cut-out 1118 may be provided in the tab 1116*b* of the plurality of tabs 1116*a*-1116*d*.

Figure 11D:
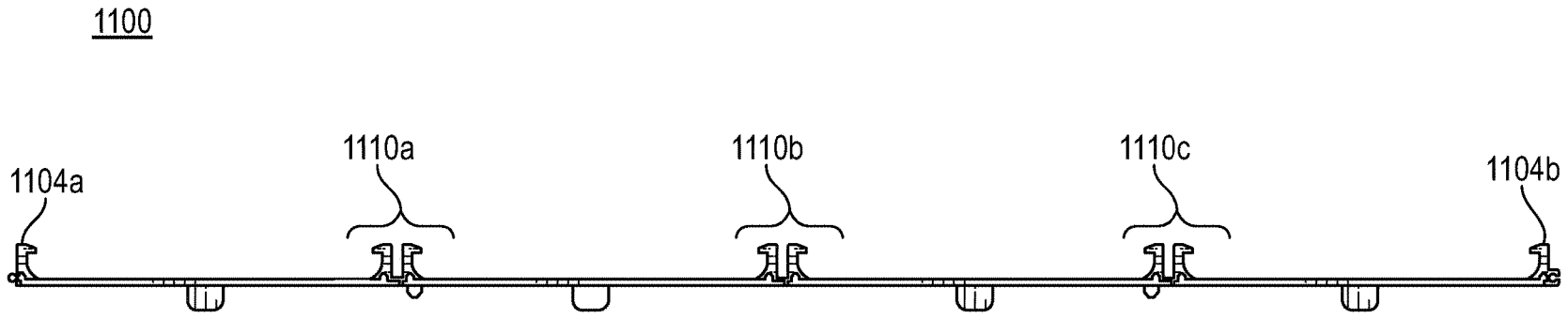
FIG. 11D illustrates a back view of the step clip fastening device, according to the alternate embodiment of the present invention.

FIG. 11D illustrates a back view of the step clip fastening device 1100, according to an alternate embodiment of the present invention. The step clip fastening device 1100 comprises the elongated base strip 1102, the step clip 1104*a* attached to the first end 1106 of the base strip 1102, the step clip 1104*b* attached to the second end 1108 of the base strip 1102, and the clip sets 1110, as discussed in FIG. 11A and FIG. 11B.

Figure 11E:
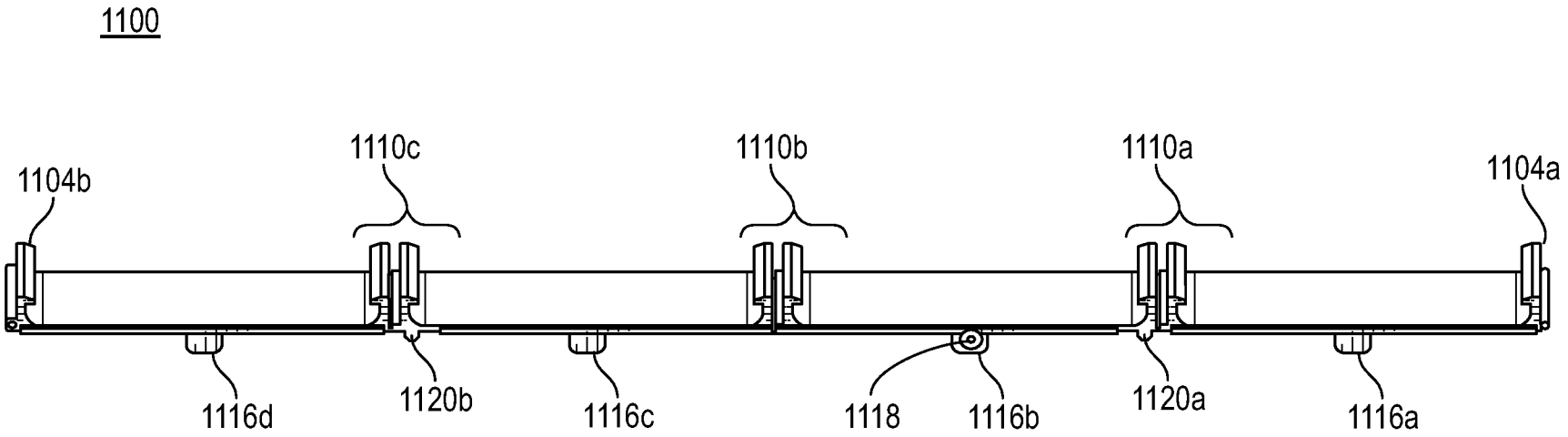
FIG. 11E illustrates a top perspective view of the step clip fastening device, according to the alternate embodiment of the present invention.

FIG. 11E illustrates a top perspective view of the step clip fastening device 1100, according to an alternate embodiment of the present invention. The step clip fastening device 1100 comprises the elongated base strip 1102, the step clip 1104*a* attached to the first end 1106 of the base strip 1102, the step clip 1104*b* attached to the second end 1108 of the base strip 1102, and the clip sets 1110, as discussed in FIG. 11A. According to an embodiment of the present invention, the step clip fastening device 1100 further comprises the protrusions 1120 attached to the base strip 1102 near the bottom surface of the every alternate step clip sets 1110. The protrusions 1120 may be integrally designed with the base strip 1102 in an embodiment of the present invention.

According to embodiments of the present invention, the step clip fastening device 1100 comprises the plurality of tabs 1116*a*-1116*d* extending substantially perpendicularly downwards from the base strip 1102 between two corresponding step clips 1110 facing each other. Further, the plurality of tabs 1116*a*-1116*d* may be an arc head shaped tab that may be used to align the step clip fastening device 1100 on a surface of a joist, according to embodiments of the present invention. In another embodiment of the present invention, the plurality of tabs 1116*a*-1116*d* may be an oval head shaped tab. Further, the plurality of tabs 1116*a*-1116*d* may be designed to enable the step clip fastening device 1100 to be aligned with a side wall of the joist and may keep the step clip fastening device 1100 parallel to a top surface of the joist for quick and efficient installation. According to an embodiment of the present invention, at least one of the plurality of tabs 1116*a*-1116*d* of the step clip fastening device 1100 may comprise the cut-out 1118 that may be provided to significantly decrease a stiffness of the tabs 1116*a*-1116*d*. In a preferred embodiment of the present invention, the cut-out 1118 may be provided in the tab 1116*b* of the plurality of tabs 1116*a*-1116*d*.

Figure 11F:
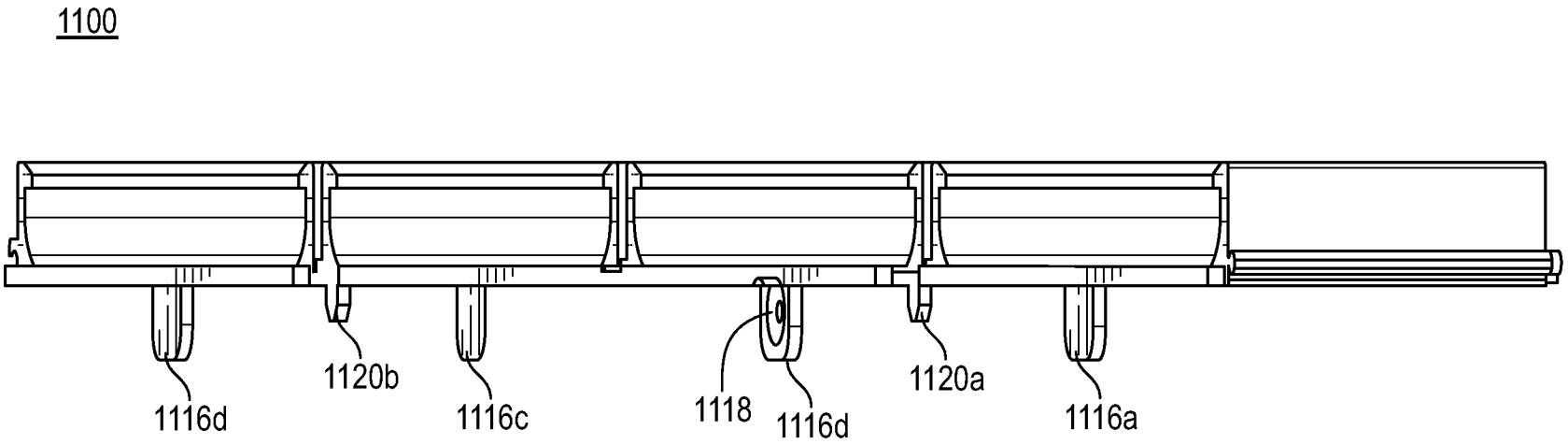
FIG. 11F illustrates a right side view of the step clip fastening device, according to the alternate embodiment of the present invention.

FIG. 11F illustrates a right side view of the step clip fastening device 1100, according to an alternate embodiment of the present invention. According to an embodiment of the present invention, the step clip fastening device 1100 comprises the protrusions 1120 attached to the base strip 1102 near the bottom surface of the every alternate step clip sets 1110. The protrusions 1120 may be integrally designed with the base strip 1102 in an embodiment of the present invention. According to embodiments of the present invention, the step clip fastening device 1100 comprises the plurality of tabs 1116*a*-1116*d* extending substantially perpendicularly downwards from the base strip 1102 between two corresponding step clips 1110 facing each other. Further, the plurality of tabs 1116*a*-1116*d* may be an arc head shaped tab that may be used to align the step clip fastening device 1100 on a surface of a joist, according to embodiments of the present invention. In another embodiment of the present invention, the plurality of tabs 1116*a*-1116*d* may be an oval head shaped tab. Further, the plurality of tabs 1116*a*-1116*d* may be designed to enable the step clip fastening device 1100 to be aligned with a side wall of the joist and may keep the step clip fastening device 1100 parallel to a top surface of the joist for quick and efficient installation. According to an embodiment of the present invention, at-least one of the plurality of tabs 1116*a*-1116*d* of the step clip fastening device 1100 may comprise the cut-out 1118 that may be provided to significantly decrease a stiffness of the tabs 1116*a*-1116*d*. In a preferred embodiment of the present invention, the cut-out 1118 may be provided in the tab 1116*b* of the plurality of tabs 1116*a*-1116*d*.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

While the foregoing is directed to embodiments of the present disclosure, other and further embodiments of the present disclosure may be devised without departing from the basic scope thereof. It is understood that various embodiments described herein may be utilized in combination with any other embodiment described, without departing from the scope contained herein. Further, the foregoing description is not intended to be exhaustive or to limit the disclosure to the precise form disclosed.

Modifications and variations are possible in light of the above teachings or may be acquired from practice of the disclosure. Certain exemplary embodiments may be identified by use of an open-ended list that includes wording to indicate that the list items are representative of the embodiments and that the list is not intended to represent a closed list exclusive of further embodiments. Such wording may include "e.g.," "etc.," "such as," "for example," "and so forth," "and the like," etc., and other wording as will be apparent from the surrounding context.

The invention claimed is:

1. A method of assembling a deck board having an upper surface and a lower surface by using a first step clip fastening device, the method comprising the steps of:

fastening the first step clip fastening device onto a joist, wherein the first step clip fastening device includes a base strip and a plurality of clip sets, wherein the base strip is configured with a greater width than a width of the plurality of step clip sets such that the base strip extends over edges of a surface of the joist;

providing a first and second anchor configured as protrusions disposed at respective first and second inner cavities of the plurality of step clip sets;

sliding a first end of the deck board into the first inner cavity of a first step clip of the plurality of step clip sets attached at a first end of the step clip fastening device to thereby engage the first anchor with the first end of the deck board; and snapping a second end of the deck board into the second inner cavity of a second step clip of the plurality of step clip sets, the second step clip facing the first step clip to form a mating relationship between the deck board and the first step clip fastening device, wherein the snapping of the second end of the deck board into the second inner cavity engages the second anchor in the second inner cavity of the second step clip with the second end of the deck board.

2. The method of claim 1, further comprising a step of positioning the first step clip fastening device on the surface of the joist by aligning a plurality of tabs extending substantially perpendicularly downwards from the step clip fastening device with a side wall of the joist.

3. The method of claim 2, wherein a shape of each of the plurality of tabs is selected from one of, an arc shape, an oval shape, or a combination thereof.

4. The method of claim 1, further comprising a step of positioning the deck board onto the first step clip fastening device, wherein the deck board is positioned between the first and second step clip facing each other.

5. The method of claim 1, further comprising a step of engaging the first step clip fastening device within a groove of the deck board.

6. The method of claim 1, further comprising a step of enabling the first anchor provided at a center of the first inner cavity of the first and second step clips to dig into the deck board.

7. The method of claim 6, wherein the first anchor is removably attached to the first inner cavity of at least one of the first and second step clips.

8. The method of claim 1, further comprising a step of joining a second step clip fastening device with the first step clip fastening device by engaging a female locking part attached at a first end of the first step clip fastening device with a male locking part attached at a second end of the second step clip fastening device.

9. The method of claim 1, wherein a width of a base strip of the first step clip fastening device is such that the base strip extends beyond at least one of the first and second step clips on the surface of the joist.

10. The method of claim 1, further comprising a step of joining a second step clip fastening device with the first step clip fastening device by engaging a concave cavity section attached at a first end of the first step clip fastening device with a second end of the second step clip fastening device in one or more back to back configurations.

11. The method of claim 1, wherein the plurality of anchors provide friction with respect to the deck board and restrict the movement of the deck board in a horizontal direction.

12. A method of assembling a plurality of deck boards having an upper surface and a lower surface by using a first step clip fastening device, the method comprising the steps of:

fastening the first step clip fastening device onto a joist, wherein the first step clip fastening device includes a base strip and a plurality of clip sets, wherein the base strip is configured with a greater width than a width of the plurality of step clip sets such that the base strip extends over edges of a surface of the joist;

providing first and second anchors configured as protrusions disposed at respective first and second inner cavities of the plurality of step clip sets;

sliding a first end of a first deck board of the plurality of deck boards into the first inner cavity of a first step clip attached at a first end of the first step clip fastening device to thereby engage the first anchor with the first end of the first deck board;

snapping a second end of the first deck board into the second inner cavity of a second step clip of the plurality of step clip sets, the second step clip facing the first step clip to form a mating relationship between the at least one of the plurality of deck boards and the first step clip fastening device, wherein the snapping of the second end of the first deck board into the second inner cavity engages the second anchor in the second inner cavity of the second step clip with the second end of the deck board;

sliding a first end of a second deck board of the plurality of deck boards into a third inner cavity of a third step clip attached in a back-to-back configuration with the second step clip facing the first step clip attached at the first end of the first step clip fastening device; and snapping a second end of the second deck board into a fourth inner cavity of a corresponding fourth step clip facing the third step clip attached in the back-to-back configuration to form a mating relationship between the second deck board and a second step clip fastening device.

13. The method of claim 12, further comprising a step of positioning the first step clip fastening device on the surface of the joist by aligning a plurality of tabs extending substantially perpendicularly downwards from the first step clip fastening device with a side wall of the joist.

14. The method of claim 13, wherein a shape of each of the plurality of tabs is selected from one of, an arc shape, an oval shape, or a combination thereof.

15. The method of claim 12, further comprising a step of positioning the first deck board onto the first step clip fastening device, wherein the first deck board is positioned between the first and second step clips facing each other.

16. The method of claim 12, further comprising a step of engaging the first step clip fastening device within a groove of the first deck board.

17. The method of claim 12, further comprising a step of enabling the first anchor provided at a center of the first inner cavity of each of the first and second step clips to dig into the first deck board.

18. The method of claim 17, wherein the first anchor is removably attached to the first inner cavity of each of the first and second step clips.

19. The method of claim 12, further comprising a step of joining the second step clip fastening device with the first step clip fastening device by engaging a female locking part attached at a first end of the first step clip fastening device with a male locking part attached at a second end of the second step clip fastening device.

20. The method of claim 12, wherein a width of a base strip of the step clip fastening device extends beyond both of the first and second step clips on the surface of the joist.

* * * * *